US010633766B2

(12) United States Patent
Haff et al.

(10) Patent No.: US 10,633,766 B2
(45) Date of Patent: Apr. 28, 2020

(54) METHOD AND APPARATUS FOR COLLECTING CROSS-ALIGNED FIBER THREADS

(71) Applicant: University of Central Oklahoma, Edmond, OK (US)

(72) Inventors: Maurice Haff, Edmond, OK (US); Morshed Khandaker, Edmond, OK (US); William Paul Snow, Edmond, OK (US)

(73) Assignee: University of Central Oklahoma, Edmond, OK (US)

( * ) Notice: Subject to any disclaimer, the term of this patent is extended or adjusted under 35 U.S.C. 154(b) by 0 days.

(21) Appl. No.: 16/508,620

(22) Filed: Jul. 11, 2019

(65) Prior Publication Data

US 2019/0338445 A1 Nov. 7, 2019

Related U.S. Application Data

(63) Continuation-in-part of application No. 16/460,589, filed on Jul. 2, 2019, and a continuation-in-part of application No. 14/734,147, filed on Jun. 9, 2015.
(Continued)

(51) Int. Cl.

| | |
|---|---|
| ***D01D 5/00*** | (2006.01) |
| ***D04H 1/728*** | (2012.01) |
| ***D01D 5/34*** | (2006.01) |

(52) U.S. Cl.
CPC ..... *D01D 5/0084* (2013.01); *D01D 5/34* (2013.01); *D04H 1/728* (2013.01); *D10B 2331/041* (2013.01); *D10B 2509/022* (2013.01)

(58) Field of Classification Search
CPC ..... D01D 5/0061–0084; B05B 5/0536; B05B 5/14; B05B 5/082; B05D 3/0254; B05C 19/025
See application file for complete search history.

(56) References Cited

U.S. PATENT DOCUMENTS 692,631 A 2/1902 Cooley
1,975,504 A 10/1934 Formhals
(Continued)

FOREIGN PATENT DOCUMENTS

CN 1687493 A 10/2005
CN 1766181 A 5/2006
(Continued)

OTHER PUBLICATIONS

Yarin et al., "Branching in electrospinning of nanofibers", Journal of Applied Physics 98, pp. 064501, 2005, pp. 1-12.
(Continued)

*Primary Examiner* — Karl Kurple
*Assistant Examiner* — Stephen A Kitt
(74) *Attorney, Agent, or Firm* — Berenato & White, LLC

(57) ABSTRACT

An apparatus for collecting cross-aligned fiber threads, comprising an elongated assembly having a plurality of segments including at least a first segment, a second segment, and an intermediate segment, the first segment positioned at one end of the intermediate segment and the second segment positioned at an opposite end of the intermediate segment, each segment being electrically chargeable; an electrically chargeable emitter for electrospinning nanoscale fiber streams comprising charged fiber branches, the emitter having a tip positioned offset and between an edge of the first segment and an edge of the second segment; a support structure for rotating the elongated assembly about a longitudinal axis and applying an electrical charge to at least the edges of the first and second segment; at least one electrically chargeable steering electrode for attracting fiber streams, the at least one steering electrode chargeable with an electrical polarity opposing a charge applied to the emitter.

14 Claims, 26 Drawing Sheets

Related U.S. Application Data

(60) Provisional application No. 62/038,506, filed on Aug. 18, 2014.

(56) References Cited

U.S. PATENT DOCUMENTS

| | | | | |
|---|---|---|---|---|
| 2,109,333 | A | 2/1938 | Formhals | |
| 2,123,992 | A | 7/1938 | Formhals | |
| 2,187,306 | A | 1/1940 | Formhals | |
| 2,349,950 | A | 5/1944 | Formhals | |
| 6,106,913 | A | 8/2000 | Scardino et al. | |
| 6,355,699 | B1 | 3/2002 | Vyakarnam et al. | |
| 6,743,273 | B2 | 6/2004 | Chung et al. | |
| 6,753,454 | B1 | 6/2004 | Smith et al. | |
| 6,821,479 | B1 | 11/2004 | Smith et al. | |
| 7,575,707 | B2 | 8/2009 | Xia | |
| 7,828,539 | B1 | 11/2010 | Beachley et al. | |
| 7,993,567 | B2 | 8/2011 | Scott-Carnell et al. | |
| 8,157,554 | B2 | 4/2012 | Petras et al. | |
| 8,852,621 | B2 | 10/2014 | Patel et al. | |
| 9,359,694 | B2 | 6/2016 | Khandaker et al. | |
| 9,809,906 | B2 | 11/2017 | Khandaker et al. | |
| 2002/0104606 | A1 | 8/2002 | Ohzuru et al. | |
| 2005/0104606 | A1 | 5/2005 | Donsky | |
| 2005/0137675 | A1 | 6/2005 | Dubson et al. | |
| 2005/0224998 | A1 | 10/2005 | Andrady et al. | |
| 2006/0226580 | A1 | 10/2006 | Xia et al. | |
| 2007/0269481 | A1* | 11/2007 | Li | A61L 27/18 424/423 |
| 2007/0275458 | A1 | 11/2007 | Gouma | |
| 2008/0170982 | A1 | 7/2008 | Zhang et al. | |
| 2008/0241538 | A1 | 10/2008 | Lee et al. | |
| 2008/0290554 | A1 | 11/2008 | Wu et al. | |
| 2009/0108503 | A1 | 4/2009 | Scott-Carnell | |
| 2009/0294733 | A1 | 12/2009 | Branham et al. | |
| 2009/0324950 | A1 | 12/2009 | Kim | |
| 2010/0112020 | A1 | 5/2010 | Westbroek et al. | |
| 2010/0197027 | A1 | 8/2010 | Zhang et al. | |
| 2010/0327494 | A1 | 12/2010 | Jabbari | |
| 2013/0273801 | A1 | 10/2013 | Young | |
| 2014/0079759 | A1 | 3/2014 | Patel et al. | |
| 2014/0141152 | A1* | 5/2014 | Sostek | A61F 2/04 427/2.24 |

FOREIGN PATENT DOCUMENTS

| | | | |
|---|---|---|---|
| CN | 1776033 | A | 5/2006 |
| EP | 2045375 | A1 | 4/2009 |
| KR | 101224544 | B1 | 1/2013 |
| KR | 101689740 | B1 | 12/2016 |
| WO | WO2004074559 | A1 | 9/2004 |
| WO | WO2005073442 | A1 | 8/2005 |
| WO | WO2005123995 | A1 | 12/2005 |
| WO | WO2006052039 | A1 | 5/2006 |
| WO | WO2006135147 | A1 | 12/2006 |
| WO | WO2009101472 | A2 | 8/2009 |

OTHER PUBLICATIONS

Ali et al., "Electrospinning of Continuous Nanofiber Bundles and Twisted Nanofiber Yarns", Nanofibers—Production, Properties and Functional Applications, 2011, pp. 153-174.

Li et al., "Electrospinning of Nanofibers: Reinventing the Wheel?**", Advanced Materials, 2004, vol. 16, No. 14, pp. 1151-1170.

Peterson, "Hybrid Nanomanufacturing Process for High-Rate Polymer Nanofiber Production", University of Nebraska—Lincoln, DigitalCommons@University of Nebraska—Lincoln, Engineering Mechanics Dissertations & Theses, 2010, 159 pages.

KdScientific, "Inflowmation Chronicles Highlights of Interesting Scientific Applications", Inflowmation Chronicles, Issue 1001, Spring 2009, 2 pages.

Theron et al., "Electrostatic field-assisted alignment of electrospun nanofibres", Nanotechnology, 12, 2001, pp. 384-390.

Tan et al., "Tensile testing of a single ultrafine polymeric fiber", Biomaterials 26, 2005, pp. 1453-1456.

Bashar Haseeb, "Controlled deposition and alignment of electrospun PMMA-g-PDMS nanofibers by novel alectrospinning setups", Master of Science Thesis, KTH Chemical Science and Engineering, Stockholm, Sweden 2011, 164 pages.

Monika Rajput, "Optimization of Electrospinning Parameters to Fabricate Aligned Nanofibers for Neural Tissue Engineering", A Thesis Submitted in Partial Fulfillment of the Requirement for the Degree of Master of Technology in Biotechnology & Medical Engineering, Department of Biotechnology and Medical Engineering, National Institute of Technology, Rourkela, Orissa, India, 2012, 74 pages.

Neves et al., "Patterning of polymer nanofi ber meshes by electrospinning for biomedical applications", International Journal of Nanomedicine, 2007, 2(3), pp. 433-448.

Yee, W.A., et al., "Stress-induced structural changes in electrospun polyvinylidene difluoride nanofibers collected using a modified rotating disk," Polymer, Elsevier Science Publishers, VG, GB vol. 49, No. 19, Sep. 2008, pp. 4196-4203.

Zussman E., et al.,"Assembly of electronspun nanofibers into cross-bars," Nanotechnology, 2002, IEEE-Nano 2002, Proceedings of the 2002 2nd IEEE Conference on Aug. 26-28, 2002, Piscataway, NJ, Aug. 26, 2002, pp. 283-286.

Jianfeng Zhange, et al., "Preparation of biaxial orientation mats from single fibers," Advances in Polymer Technol. Viley and Sons, Hoboken NJ, vol. 21, Jan. 1, 2018, pp. 606-608.

Carnell, Lisa A., et al., "Aligned Mats from Electrospun Singer Fibers", Macromolecules, vol. 41, No. 14, Jun. 26, 2008, pp. 5345-5349.

Partial EP search report for corresponding EP15833663 dated Apr. 12, 2018.

Choi JS, Lee SJ, Christ GJ, Atala A, Yoo JJ. The influence of electrospun aligned poly(epsilon-caprolactone)/collagen nanofiber meshes on the formation of self-aligned skeletal muscle myotubes. Biomaterials. Jul. 2008; 29(19):2899-906.

R. Frykberg,J. Banks (2015) "Challenges in the Treatment of Chronic Wounds" Advances in Wound Care, vol. 4, No. 9, 560-582.

Reneker, D. H., A. L. Yarin, H. Fong and S. Koombhongse (2000) "Bending instability of electrically charged liquid jets of polymer solutions in electrospinning." Journal of Applied physics 87(9): 4531-4547.

Zahra Abdali, Sarvesh Logsetty, and Song Liu, Bacteria-Responsive Single and Core-Shell Nanofibrous Membranes Based on Polycaprolactone/Poly(ethylene succinate) for On-Demand Release of Biocides, ACS Omega 2019 4 (2), 4063-4070.

* cited by examiner

590

```
_90_deg_turn_program | Arduino 1.0.5
File Edit Sketch Tools Help
_90_deg_turn_program
#include <Servo.h>
#define TURN_TIME 340

Servo myservo;

void setup()
{
    myservo.attach(10);

    myservo.write(94);
}

void loop()
{
    myservo.write(180);
    delay(TURN_TIME);
    myservo.write(94);
    delay (2000);
}
```

FIG. 5E

METHOD AND APPARATUS FOR COLLECTING CROSS-ALIGNED FIBER THREADS

CROSS REFERENCES TO RELATED APPLICATIONS

This application is a continuation-in-part of U.S. patent application Ser. No. 16/460,589 filed on Jul. 2, 2019 by the University of Central Oklahoma (Applicant), entitled "Method and apparatus for accumulating cross-aligned fiber in an electrospinning device" the entire disclosure of which is incorporated herein by reference in its entirety for all purposes. This application is a continuation-in-part of U.S. patent application Ser. No. 14/734,147 filed Jun. 9, 2015 by the University of Central Oklahoma (Applicant), entitled "Method and apparatus for controlled alignment and deposition of branched electrospun fiber" the disclosure of which is incorporated herein by reference in its entirety for all purposes. This application also claims the benefit of U.S. Provisional Patent Application No. 62/038,506 filed on Aug. 18, 2014 in the name of Morshed Khandaker and William Paul Snow, which is expressly incorporated herein by reference in its entirety.

All of the references, patents and patent applications that are referred to herein are incorporated by reference in their entirety as if they had each been set forth herein in full. Note that this application is one in a series of applications covering methods and apparatus for enabling biomedical applications of nanofibers and other uses. The disclosure herein goes beyond that needed to support the claims of the particular invention set forth herein. This is not to be construed that the inventor is thereby releasing the unclaimed disclosure and subject matter into the public domain. Rather, it is intended that patent applications have been or will be filed to cover all of the subject matter disclosed below and in the current assignee's granted and pending applications. Also please note that the terms frequently used below "the invention" or "this invention" is not meant to be construed that there is only one invention being discussed. Instead, when the terms "the invention" or "this invention" are used, it is referring to the particular invention being discussed in the paragraph where the term is used.

STATEMENT AS TO RIGHTS TO INVENTIONS MADE UNDER FEDERALLY SPONSORED RESEARCH OR DEVELOPMENT

This invention was made with government support under Grant Number 5P20GM103447 awarded by the National Institutes of Health. The government has certain rights in the invention.

FIELD OF THE INVENTION

The present invention generally relates to the field of polymer fiber production. More specifically, the invention relates to the deposition of aligned fibers of micron to nano size diameters on different shapes of metallic implants and other types of substrates from a branched polymer during an electrospin process.

BACKGROUND OF THE INVENTION

The basic concept of electrostatic spinning (or electrospinning) a polymer to form extremely small diameter fibers was first patented by Anton Formhals (U.S. Pat. No. 1,975, 504). Electrostatically spun fibers and nonwoven webs formed therefrom have traditionally found use in filtration applications, but have begun to gain attention in other industries, including in nonwoven textile applications as barrier fabrics, wipes, medical and pharmaceutical uses, and the like.

Electrospining is a process by which electrostatic polymer fibers with micron to nanometer size diameters can be deposited on a substrate. Such fibers have a high surface area to volume ratio, which can improve the structural and functional properties of the substrate. Typically, a jet of polymer solution is driven from a highly positive charged metallic needle to the substrate which is typically grounded. Sessile and pendant droplets of polymer solutions may then acquire stable shapes when they are electrically charged by applying an electrical potential difference between the droplet and a flat plate. These stable shapes result only from equilibrium of the electric forces and surface tension in the cases of inviscid, Newtonian, and viscoelastic liquids. In liquids with a nonrelaxing elastic force, that force also affects the shapes. When a critical potential has been reached and any further increase will destroy the equilibrium, the liquid body acquires a conical shape referred to as the Taylor cone.

Naturally derived as well as synthetic polymers like collagen, gelatin, chitosan, poly (lactic acid) (PLA), poly (glycolic acid) (PGA), and poly(lactide-co-glycolide) (PLGA) have been used for electrospinning. In addition to the chemical structure of the polymer, many parameters such as solution properties (e.g., viscosity, conductivity, surface tension, polymer molecular weight, dipole moment, and dielectric constant), process variables (e.g., flow rate, electric field strength, distance between the needle and collector, needle tip design, and collector geometry), and ambient conditions (e.g., temperature, humidity, and air velocity) can be manipulated to produce fibers with desired composition, shape, size, and thickness. Polymer solution viscosity and collector geometry are important factors determining the size and morphology of electrospun fibers. Below a critical solution viscosity, the accelerating jet from the tip of the capillary breaks into droplets as a result of surface tension. Above a critical viscosity, the repulsive force resulting from the induced charge distribution on the droplet overcomes the surface tension, the accelerating jet does not break up, and results in collection of fibers on the grounded target. Although the jet of fiber divides into many branches on its surface after the jet leaves the tip of the needle (Yarin, K Yarin, A. L., W. Kataphinan and D. H. Reneker (2005). "Branching in electrospinning of nanofibers." *Journal of Applied Physics* 98(6):—ataphinan et al. 2005). If not controlled, the branches of the fibers create a non-uniform deposition on the substrate. An objective of this invention is to enable control of deposition of branches of the fibers to provide uniform distribution of the fiber on a substrate.

Many engineering applications require uniform distribution of the fiber on the substrate. For example, one of the most important cell morphologies associated with tissue engineering is elongated unidirectional cell alignment. Many tissues such as nerve, skeletal and cardiac muscle, tendon, ligament, and blood vessels contain cells oriented in a highly aligned arrangement, thus it is desirable that scaffolds designed for these tissue types are able to induce aligned cell arrangements. It is well documented that cells adopt a linear orientation on aligned substrates such as grooves and fibers. Aligned nanofiber arrays can be fabricated using the electrospinning method [Li D, Xia Y. Electrospinning of nanofibers: reinventing the wheel? Adv Mater. 2004; 16:1151-1170] and many studies have shown that cells align with the direction of the fibers in these scaffolds.

In addition to the influence on fiber arrangement, cell alignment can have positive effects on cell growth within tissue engineering scaffolds. Myotubes formed on aligned nanofiber scaffolds were more than twice the length of myotubes grown on randomly oriented fibers ($p<0.05$) and neurites extending from DRG explants on highly aligned scaffolds were 16 and 20% longer than those grown on intermediate and randomly aligned scaffolds respectively [Choi J S, Lee S J, Christ G J, Atala A, Yoo J J. The influence of electrospun aligned poly(epsilon-caprolactone)/collagen nanofiber meshes on the formation of self-aligned skeletal muscle myotubes. Biomaterials. 2008 July; 29(19):2899-906].

Growth of electrical bending instability (also known as whipping instability) and further elongation of the jet may be accompanied with the jet branching and/or splitting. Branching of the jet of polymer during the electrospin process has been observed for many polymers, for example, polycaprolactone (PCL)(Yarin, Kataphinan et al. 2005), polyethylence oxide (Reneker, D. H., A. L. Yarin, H. Fong and S. Koombhongse (2000) "Bending instability of electrically charged liquid jets of polymer solutions in electrospinning." *Journal of Applied physics* 87(9): 4531-4547). Such branching produces non-uniform deposition of fiber on the collector during the electrospin process. A method and apparatus to separate out a continuous single thread of fiber from many fiber branches has not been solved. A method is needed by which uniformly distributed single thread fiber can be deposited on a substrate during electrospinning processes for various engineering applications requiring uniform, controlled fiber deposition on a substrate, including enabling elongated unidirectional cell alignment.

Chronic wound care consumes a massive share of total healthcare spending globally. Care for chronic wounds has been reported to cost 2% to 3% of the healthcare budgets in developed countries (R. Frykberg, J. Banks (2015) "Challenges in the Treatment of Chronic Wounds" Advances in Wound Care, Vol. 4, Number 9, 560-582). In the United States, chronic wounds impact nearly 15% of Medicare beneficiaries at an estimated annual cost of $28 billion. In Canada, the estimated cost to the health system is $3.9 billion. Despite significant progress over the past decade in dealing with chronic (non-healing) wounds, the problem remains a significant challenge for healthcare providers and continues to worsen each year given the demographics of an aging population. Persistent chronic pain associated with chronic wounds is caused by tissue or nerve damage and is influenced by dressing changes and chronic inflammation at the wound site. Chronic wounds take a long time to heal and patients can suffer from chronic wounds for many years. Wound dressings are often extremely painful to remove, particularly for severe burn wounds. The removal of these dressings can peel away the fresh and fragile skin that is making contact with the dressing, causing extreme pain and prolonged recovery time. There is also a greater risk for infection and the onset of sepsis, which is can be fatal.

Research at the University of Manitoba has demonstrated positive effects of antimicrobial nanofiber membranes in treating the conditions of infection in chronic wounds (Abdali Z, Logsetty S, Song L, "Bacteria Responsive Single and Core-shell Nanofibrous Membranes based on Polycaprolactone/Poly(ethylene succinate) for On-demand Release of Biocides" ACS Applied Biomaterials (2018). A PHA based core-shell structural nanofibrous mat incorporating a broad-spectrum potent biocide in the core of the nanofibers was fabricated by coaxial electrospinning (Li W, "Bacteria-triggered Release of a Potent Biocide from Core-shell Polyhydroxyalkanoate" Graduate Thesis, (2018), University of Manitoba). The method of electrospinning a core-shell nanofiborous mat used in the research is shown in FIG. 11. The nanofiborous mats produced comprised randomly oriented PHA based core-shell nanofibers. The random structure of the fibers limited surface contact with a wound and any resulting triggered release of biocides present in the outer layers of the mat. Further, the random orientation of the nanofibers presented less than optimal porosity for cell migration and exudate flow from a wound. FIG. 11 shows the electrospinning method used to produce core-shell (PHA)-based nanofibers mats for wound dressing applications developed at University of Manitoba.

One objective of the present invention is to enable fabrication of well-structured membranes comprising cross-aligned nanofibers that maximize surface contact with a wound and resulting triggered release of biocides in the presence of infection. Another objective is to enable fabrication of nanofiber membranes that provide optimal porosity for cell migration and exudate flow from a wound. Yet another objective of the present invention is to provide a method for cost-effective fabrication of cross-aligned nanofiber membranes of varying dimensions usable as an inner layer in wound care dressings. Applications of such larger size membranes may include for example wound care dressings for both full and partial thickness burns. Larger dimension cross-aligned nanofiber membranes may also be usable in other applications including, but not limited to high-volume medical grade air filters and ballistic protective fabrics.

An electrospinning apparatus developed by the National Aeronautics and Space Administration (NASA) is directed to producing larger size fiber mats comprising cross-aligned fibers. NASA's Langley Research Center created a modified electrospinning apparatus (shown in FIG. 12) for spinning highly aligned polymer fibers as disclosed in U.S. Pat. No. 7,993,567 the disclosure and teachings of which are included herein by reference in the entirety. NASA developed an apparatus that uses an auxiliary counter electrode to align fibers for control of the fiber distribution during the electrospinning process. The electrostatic force imposed by the auxiliary electrode creates a converged electric field, which affords control over the distribution of the fibers on the rotating collector surface. A polymer solution is expelled through the tip of the spinneret at a set flow rate as a positive charge is applied. An auxiliary electrode, which is negatively charged, is positioned opposite the charged spinneret. The disparity in charges creates an electric field that effectively controls the behavior of the polymer jet as it is expelled from the spinneret; it ultimately controls the distribution of the fibers and mats formed from the polymer solution as it lands on a rotating collection mandrel. The disclosure recites "Pseudo-woven mats were generated by electrospinning multiple layers in a 0°/90° lay-up. This was achieved by electrospinning the first layer onto a Kapton® film attached to the collector, removing the polymer film from the collector, rotating it 90°, reattaching it to the collector and electrospinning the second layer on top of the first, resulting in the second layer lying 90° relative to the first layer. Fibers were collected for one minute in each direction. A high degree of alignment was observed in this configuration. In order to assess the quality of a thicker pseudo-woven mat, the lay-up procedure was repeated 15 times in each direction)(0°/90° for a period of 30-60 seconds for each orientation, generating a total of 30 layers." The required and repeated step of "removing the polymer film, rotating it 90°, reattaching it to the collector and electrospinning the second layer on top of the first" is a major deficiency in the method and apparatus taught in the NASA'567 patent when considered from the perspective of cost-effective commercial production of cross-aligned nanofiber membranes. The labor and production time associated with repeated manual removal of the Kapton® film and reattachment on the collector is cost prohibitive in commercial applications. An objective of the present invention is to provide a method and apparatus for fabricating fibrous membranes comprising cross-aligned nanofibers that eliminates manual steps and provides an efficient, commercially viable process for use in producing at least a fibrous drug delivery dressing, a tissue engineering scaffold, a medical grade air filter, and protective fabrics.

SUMMARY OF THE INVENTION

Micron to nano size fibers can be applied to a variety of substrates across a range of applications to enable or enhance desired performance. For example, when nano size fibers are fused with biomedical implants, osseointegration of an implant with the host tissue in orthopedics and orthodontics is improved. The effects of fibers on the interface fracture toughness of implant/cement specimens with and without fibers at the interface have not yet been known. Such studies are important for the design of a lasting implant for orthopedic applications. In one aspect, a specific goal of the present invention is to coat different orthopedic and orthodontic implants by aligned micron to nanosize fiber for the improvement of the bonding of the implant with the surrounding biomaterial in physiological conditions. In another aspect, the present invention can also be applied to catalysis, filtration media, filler for fiber-containing composites, and scaffolds for tissue engineering. Alignment of the electrospun fibers increases the number of applications for which the fibers are suited, including for example, drug delivery dressings, optical polarizers and bone scaffold matrix.

The present invention utilizes the lateral branching of fiber from the straight whipping jet of polymer to produce reduced diameter and aligned fiber on a collector compared to the straight whipping jet of fiber. The present invention utilizes the higher stretching distance from the origin of the branch to the collector (FIG. 2-31) to produce reduce diameter fiber compared to other methods (FIG. 2-30 and FIG. 2-33).

In accordance with certain embodiments of the present disclosure, a method and apparatus is provided to control the deposition of electrospun fiber width and alignment. The method includes significant modifications of current methods of electrospinning used to deposit micro fiber and nanofiber onto a substrate. Current methods and apparatus for electrospinning typically comprise four parts: syringe pump to control flow rate, syringe with a needle which act as one of the electrodes to charge the polymer solution, high-voltage power supply to generate electric field, and collector with substrate which acts as an electrode to collect fibers as illustrated in FIG. 1 (Khandaker, M., K. C. Utsaha and T. Morris (2014). "Interfacial fracture toughness of titanium-cement interfaces: Effects of fibers and loading angles." *International Journal of Nanomedicine* 9(1)). A polymer solution, sol-gel, particulate suspension or melt is loaded into the syringe and this liquid is extruded from the needle tip at a constant rate by a syringe pump. The collector is usually a charged parallel plate structure or some form of disk rotating in a plane perpendicular to the longitudinal axis of the syringe needle. Unlike current methods, the present invention can be used for not only non-woven polymer fabric or weaving polymer fibers into a fabric, but also on round, flat, and irregular (like hip implant, orthopedic screws) shape collectors. The present invention may also be used for metal coating with a controlled aligned fiber on these collectors. The present invention is configurable with multiple disks that provide a capability to adjust the length of spun fibers applied to a substrate, enabling parallel deposition of fibers across a range of substrate physical dimensions.

In the present invention, as illustrated in FIG. 2, FIG. 3 and FIG. 4, a syringe pump, syringe with a needle and a high-power electric power supply is used, however, instead of using a single rotating target disk or a pair of charged collector strips, a rotating auxiliary metallic disk is positioned in line with the syringe needle (as illustrated in FIG. 2), and configured having two insulating washers attached using a metallic fastener (e.g., bolt) adapted to engage a metal shaft. The fastener is electrically grounded. The sharp syringe needle is centered on the edge of the metallic disk substantially aligned with the plane of disk rotation. The needle is electrically positive charged. The path of an electromagnetic field generated by the potential difference between the charged needle and the rotating auxiliary metallic disk is used to deposit and align fiber on a primary collector shape. The primary collector shape rotates on an axis substantially orthogonal to the rotational axis of the auxiliary metallic disk. The invention uses the auxiliary metallic disk to pull away fibers from a fiber stream by applying an opposed charge to produce elongated unidirectional fibers. The opposed charge on the metallic disk and the charge on the needle may be generated by the high power voltage source.

Fiber directed towards the circumference of the primary collector shape may be utilized to deposit fiber on a relatively round or on flat substrates and other more irregular shapes (like hip implant shape or electrical substrates) that may be mounted on the primary collector shaft (as illustrated in FIG. 4). The primary collector shaft (as illustrated in FIG. 2) is set spinning by a DC motor and positioned to intercept an outer band fiber branches in the electromagnetic field, which coats the collector with aligned fiber. The position of the collector shape may be altered to move the axis of rotation toward or away from the fibers aligned with the electromagnetic field. The position of the needle may be adjusted using a non-conducting support (e.g., wooden or plastic bar) attached with the tube of the syringe to increase or decrease the distance between the needle tip and the edge of the metallic disk (as illustrated in FIG. 3). The needle, primary and auxiliary disk components can be mounted in a sealable chamber to avoid disturbance of the fiber flow due to the air flow from the room to the chamber. Using the present invention, an uninterrupted direct application of aligned fibers can be applied to a variety of target samples. The target samples may be any of a plurality of shapes, including those typical of biomedical implants, biomaterial interfaces and tissue engineering scaffolds. The insulating washers, fastener (e.g., bolt head) and primary collector shape (e.g., specimen holder) of the present invention are adaptable to achieve different coating topography (fiber diameter, distance between two fiber, coating thickness) on the target (e.g., an implant) surface. Research by the named inventors has shown (discussed in example section) that the applied coating of aligned fiber on an implant can induce and improve aligned cell arrangements, including elongated unidirectional cell alignment and the strength between implant/biomaterial interfaces. Further, the present invention is confirmed to enable control of the deposition of the branches of the fibers to provide uniform distribution of the fiber on the substrate.

In another embodiment, the present invention provides a dual disk method that incorporates the advantages of the electric field of the single disk method. The present invention is reconfigurable between a single disk and a multiple disk arrangement. Significant benefits of the two disk configuration are the ability to control the length of each fiber, rapidly collect parallel fibers of the same length, and the capability of single fiber collection. This is done similarly to the single disk collection method, but instead of attracting the fibers to the center the fibers are forced to the sharp edge of the disk. This is accomplished by taking advantage of the electromagnetic field of a thin solid disk near the edge. The field lines of a point charge both positive and negative produce the path of strongest attraction. The two rotating disks take advantage of the natural oscillation of the nanofiber, and in a manner similar to the parallel plate collection method. Giving the negatively charged disks the ability to rotate and tilt produces cross-linking (stray fibers) and the arcing effect of static charge respectfully. The fibers are allowed to follow random trajectories until they encounter the electro-magnetic field of the disk. At that point the fibers align back and forth along a plain that intersects both disks. The disks are mirrored and adjusted to the desired length, with both disks being negatively charged. Due to the fibers grounding out on the disk and sharing the same charge, along with the effects of the electro-magnetic field, there is an arcing effect. This effect is adjusted in shape by introducing a slight angle to both disks in opposite directions so the tops of the blades are closer together and the bottom of the disks are slightly further apart. Then by spinning the blades the fibers are pulled tight and one can collect the fibers with greater control. (See FIGS. 5A through 5D.)

In another embodiment the present invention provides a method and apparatus for fabricating nanofiber membranes of varying dimensions, the apparatus being interchangeably re-configurable to produce membranes of different sizes, the method using an apparatus adapted from the dual disk method disclosed herein. Larger dimension membranes are needed for example in fabricating a range of fibrous drug delivery dressings including wound care dressings, as well tissue engineering scaffolds, medical grade filters, and protective fabrics. The adapted apparatus of the present invention comprises an elongated assembly having a plurality of segments consisting of at least a first segment, a second segment, and an intermediate segment, where the first segment is positioned at one end of the intermediate segment and the second segment is positioned at an opposite end of the intermediate segment. Each of the segments are electrically chargeable and the first segment and second segment present a circumferential edge to electrospun nanofibers.

In one preferred embodiment, a least one emitter is configured for electrospinning nanoscale fiber streams comprising many charged fiber branches. A plurality of emitters may also be configured to produce multiple fiber streams. The at least one emitter can be electrically charged and has a tip positioned offset away from and between the edge of the first segment and the edge of the second segment. A support structure is provided for rotating the elongated assembly about a longitudinal axis and applying an electrical charge produced by a high voltage power supply to at least the first segment and second segment. At least one electrically chargeable steering electrode is provided for attracting the charged fiber branches in fiber streams along elliptical motion pathways substantially orthogonal to motion pathways of charged fiber branches in fiber streams attracted to the first and second segments. The at least one steering electrode receives from a high voltage power supply a charge having an electrical polarity opposing a charge applied to the at least one emitter. The elongated assembly may be cylindrical and the first segment and the second segment are electrically insulated from the intermediate segment.

In one preferred embodiment, the first segment and the second segment may comprise at least thin metallic disks each rotationally mounted on a separate drive motor and moveably separable on a base mount to accept the intermediate segment between the first segment and the second segment (i.e., disks). The intermediate segment may comprise a metallic cylinder or drum that connects to the first and second segments (i.e., disks) using insulating connectors. The length of the intermediate segment (i.e., cylinder) mounted between the first and second segments (i.e., disks) determines the width of the membrane that can be fabricated. The width dimension of the membrane may be altered by inserting intermediate segments of alternate lengths. The diameters of the intermediate segment (i.e., cylinder) and first and second segments (i.e., disks) determine the length of the membrane that can be fabricated.

In another preferred embodiment, a plurality of steering electrodes may be incorporated, the steering electrodes being programmably chargeable so that elliptical motion pathways of the fiber streams toward the electrodes from the at least one electrically chargeable emitter is alterable. In addition, a plurality of programmably chargeable segments may be included adding to the number of segments positioned toward each end of the elongated assembly (e.g. cylinder), each segment being electrically chargeable and separated from an adjacent segment by a finite distance. The plurality of programmably chargeable segments may comprise metallic ribbons circumferentially engaging and electrically insulated from the surface of the elongated assembly (e.g. cylinder). Alternatively, the plurality of programmably chargeable segments may comprise interconnectable cylinders for extending the length dimension of the first and second segments.

In another preferred embodiment, a controller may be included for governing the charge status of chargeable components of the apparatus, the chargeable components receiving an electrical charge from a high-voltage power supply. The controller may be programmed for example to enable changing the charge status of the first segment and the second segment (e.g., metallic disks or ribbons) and extensions, as well as the charge status of one or a plurality of steering electrodes. The at least one steering electrode or a plurality of steering electrodes may be fixedly mounted in-line with the emitter. Alternatively, the at least one steering electrode may be movably mounted on a robotic arm for repositioning with respect to the emitter and the elongated assembly. A plurality of electrodes may also be mounted on the robotic arm. At least one steering emitter or a plurality of emitters may be fixedly mounted in-line with the at least one steering electrode. The apparatus may also be adapted with an emitter (i.e., spinneret) configured to produce electrospun core-shell nanofibers, the core and the shell comprising differing material compositions. The emitters of the apparatus may be configured to produce electrospun fibers having differing chemical compositions to produce fibrous membranes exhibiting novel characteristics.

BRIEF DESCRIPTION OF THE DRAWINGS

FIG. 5E is a non-limiting diagram showing a turn program created using Labview available from National Instruments Corporation.

DETAILED DESCRIPTION OF PREFERRED EMBODIMENTS OF THE INVENTION

Figure 1:
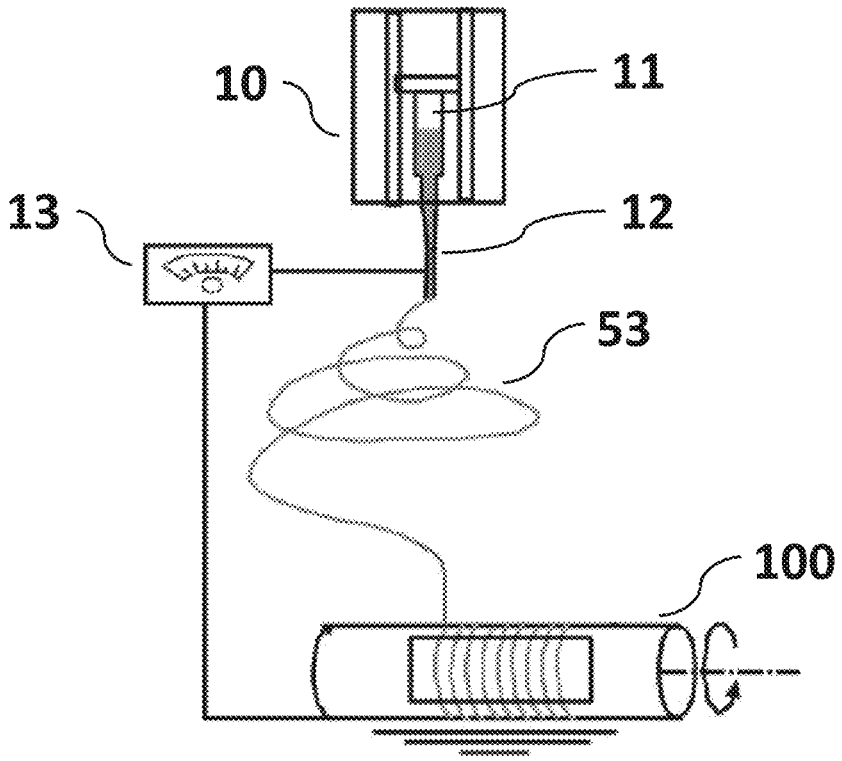
FIG. 1 is a non-limiting diagram showing a schematic view of typical laboratory setup for an Electrospinning process.

In Brief:

FIG. 1 is a non-limiting diagram schematically illustrating the method of the typical electrospin process. A typical electrospin setup consists of syringe pump, syringe with a needle, high-voltage power supply, and collector. Presently a single rotating or flat target disk, a pair of charged collector strips have been used as the fiber collector.

Figure 2:
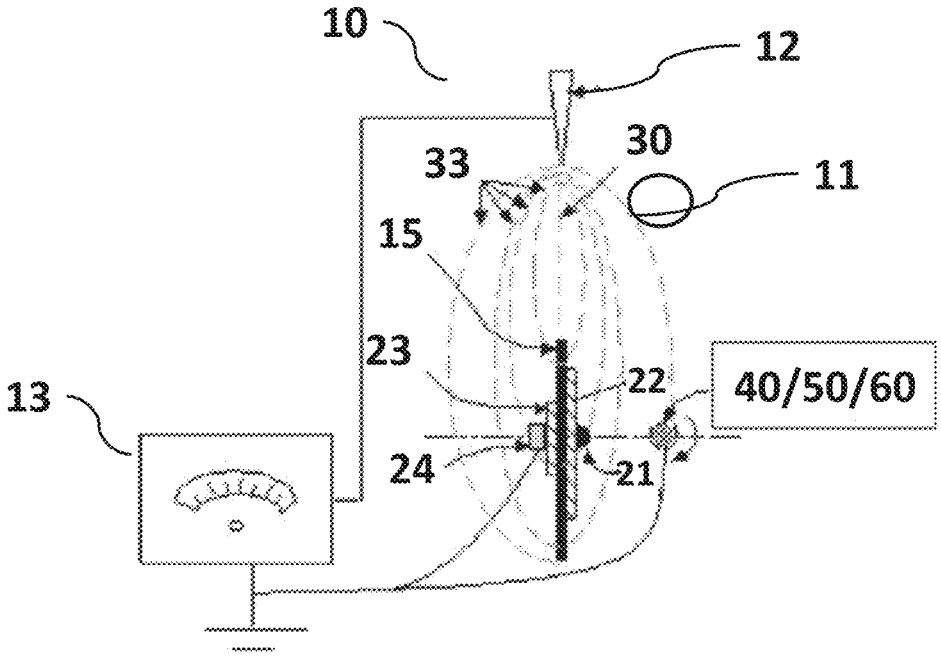
FIG. 2 is a non-limiting diagram showing a schematic view of the invention method.

FIG. 2 is a non-limiting diagram schematically illustrating the method of the present invention. The embodiment shown in the diagram uses the path of the electromagnetic field generated by the potential difference between charged needle and rotating auxiliary metallic disk using a high-power voltage source to capture, deposit and align fiber on a substrate. The apparatus shown includes the syringe needle, DC motor, blunt bolt, and front insulating washer. A linear stage is used to move the collector back and forth.

Figure 3:
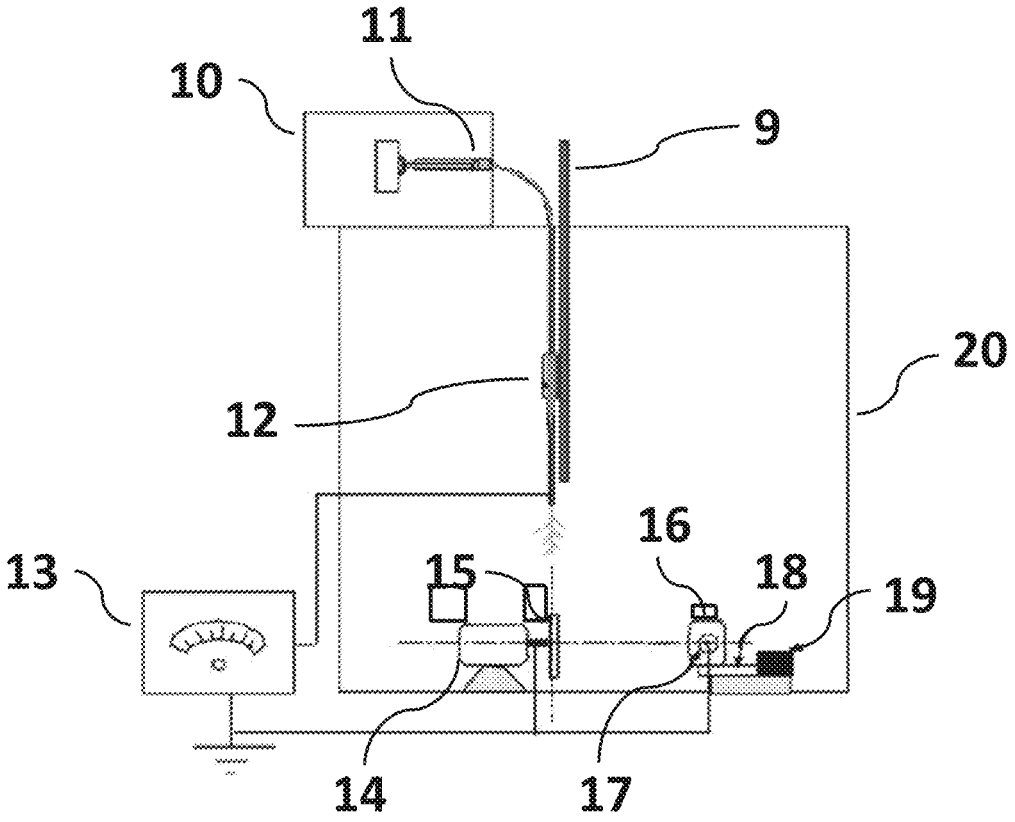
FIG. 3 is a non-limiting diagram showing components of the apparatus of the present invention.

FIG. 3 is a non-limiting diagram illustrating the components of the apparatus of the present invention. The embodiment shown in the diagram includes the sealable chamber, a syringe pump, a syringe with a tube that is attached using a non-conducting support, a syringe needle at the end of the tube, a high-voltage power supply, a rotating auxiliary metallic disk, and primary collector shapes. The metallic disk is positioned in line with the syringe needle. The metallic auxiliary disk and a primary collector shape are spun using direct current (DC) and speed controlled motors. The syringe needle is electrically charged by applying a high-voltage in the range of 5 KVA to 15 KVA produced by the power supply. An opposed charge is applied to the rotating disk by applying a high-voltage in the range of 5 KVA to 15 KVA generated by the power supply.

Figure 4:
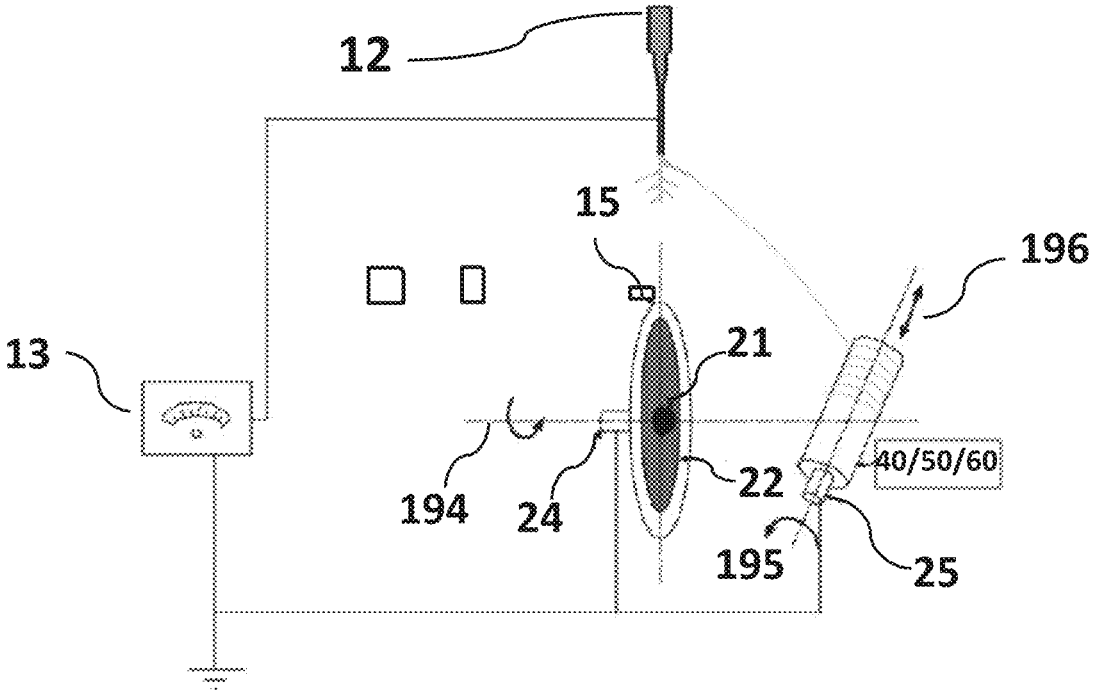
FIG. 4 is a non-limiting diagram showing the components of the apparatus of the present invention that is attached with primary and auxiliary disk.

FIG. 4 is a non-limiting diagram showing components of the apparatus of the present invention that is attached with primary and auxiliary disk. The embodiment shown in the diagram includes a syringe needle, an electric power supply, a rotating auxiliary metallic disk, and a primary collector shape. The metallic disk is positioned in line with the syringe needle, and configured having two insulating washers attached using a metallic fastener (e.g., bolt) adapted to engage (e.g., screwed into) with the motor shaft. The metallic bolt is grounded. The primary collector shape rotates on an axis substantially orthogonal to the rotational axis of the auxiliary metallic disk. The primary collector shape is grounded. The auxiliary metallic disk and the primary collector shape are spun using speed controlled, direct current (DC) motors.

Figure 5A:
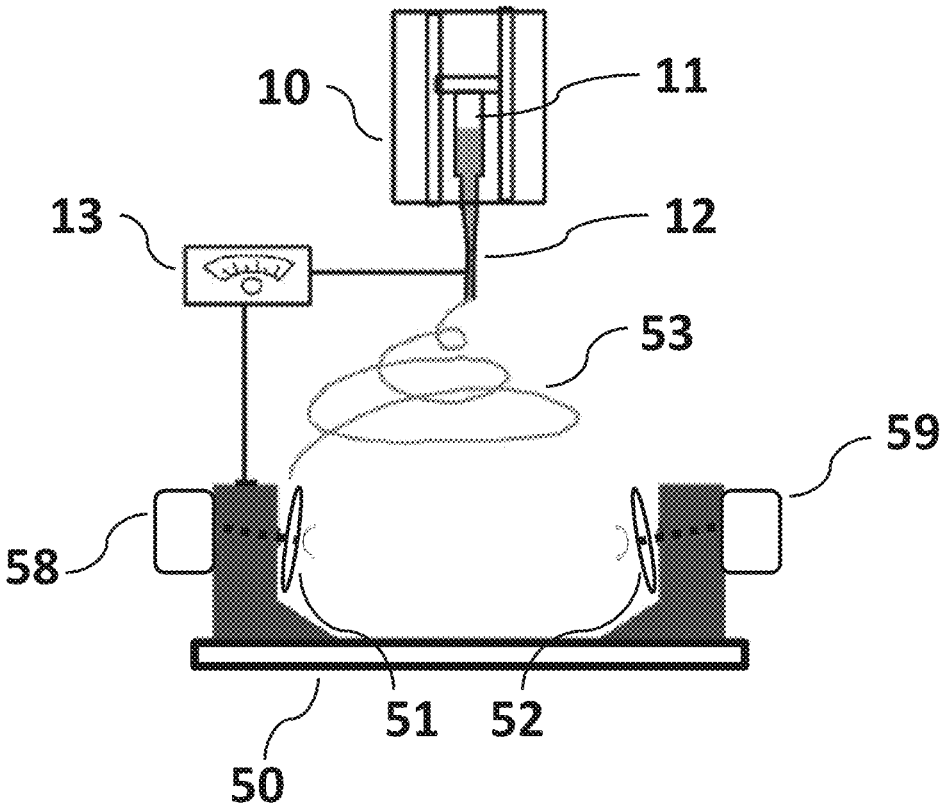
FIG. 5A is a non-limiting diagram showing a schematic view of the dual rotating disks configuration of the present invention that can be used to implement the method of controlling fiber alignment and deposition.

FIG. 5A is a non-limiting diagram showing a schematic view of the dual rotating disks configuration of the present invention that can be used to implement the method of controlling fiber alignment and deposition. The present invention provides a dual disk method that incorporates the advantages of the electric field of the single disk method.

Figure 5B:
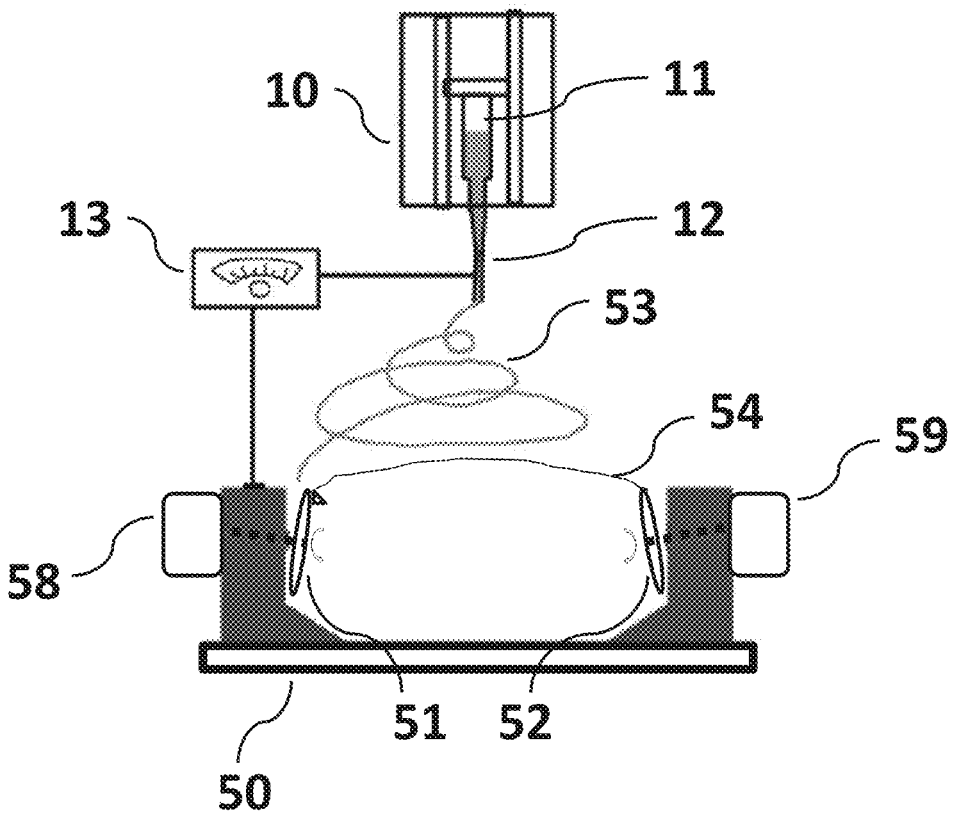
FIG. 5B is a non-limiting diagram showing how fiber control is accomplished similarly to the single disk collection method, but instead of attracting the fibers to the center of a single disk the fibers are forced to the sharp edge of the disk.

FIG. 5B is a non-limiting diagram showing how fiber control is accomplished similarly to the single disk collection method, but instead of attracting the fibers to the center of a single disk the fibers are forced to the sharp edge of the disk. The fibers are allowed to follow random trajectories until they encounter the electro-magnetic field of the disk.

Figure 5C:
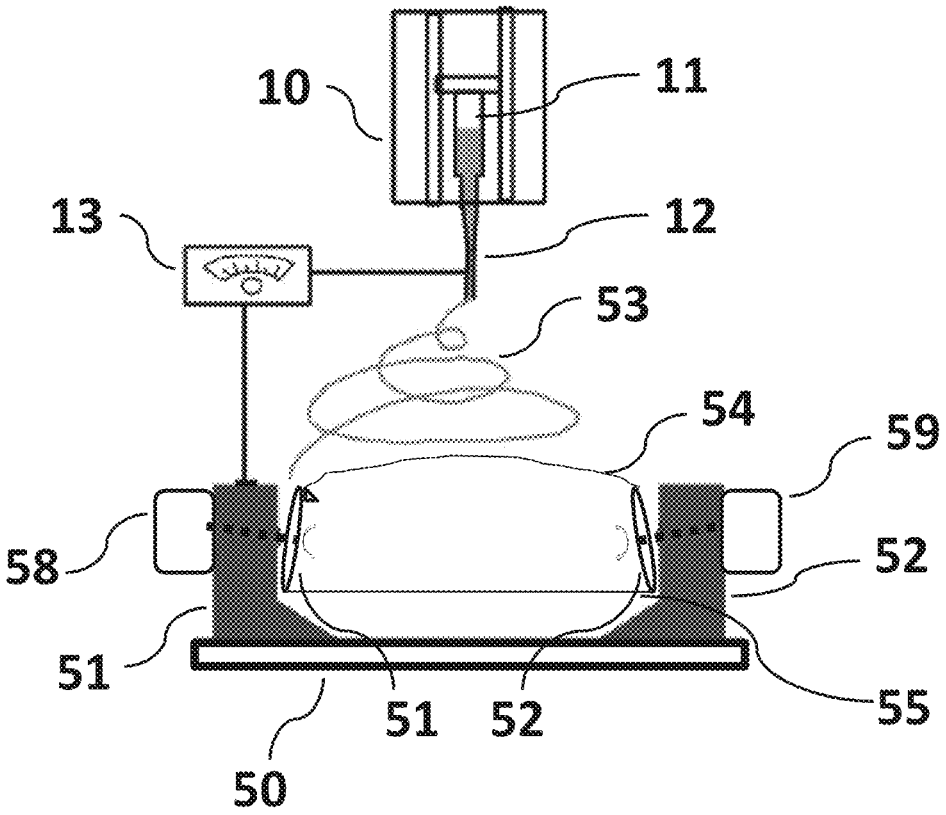
FIG. 5C is a non-limiting diagram showing the fibers pulled tight at the lower side of the disks where the fibers may be collected with greater control.

FIG. 5C is a non-limiting diagram showing the fibers pulled tight at the lower side of the disks where the fibers may be collected with greater control. Fiber length may be adjusted by increasing or decreasing the separation distance between the rotating disks.

Figure 5D:
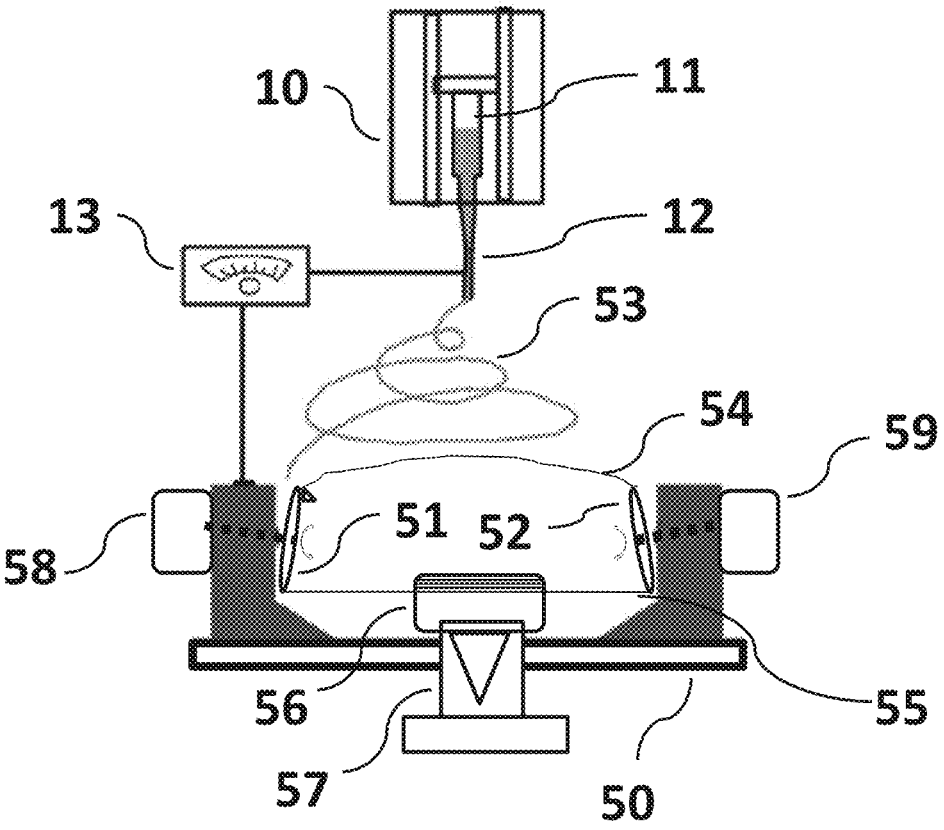
FIG. 5D is a non-limiting diagram showing a schematic view of the parallel rotating disks configuration of the present invention with a collection substrate positioned in the path of the fibers stretched between the rotating disks.

FIG. 5D is a non-limiting diagram showing a schematic view of the dual rotating disks configuration of the present invention with a collection substrate positioned in the path of the fibers stretched between the rotating disks. Once the fibers have been optimized a collection surface may be manipulated within the pathway of the stretched fibers.

FIG. 5E is a non-limiting diagram showing a turn program created using Labview available from National Instruments Corporation. To control the linear actuator motor a PWM (Pulse width modulation) circuit can be created. In developing the present invention the tool used to create the PWM was Labview.

Figure 6:
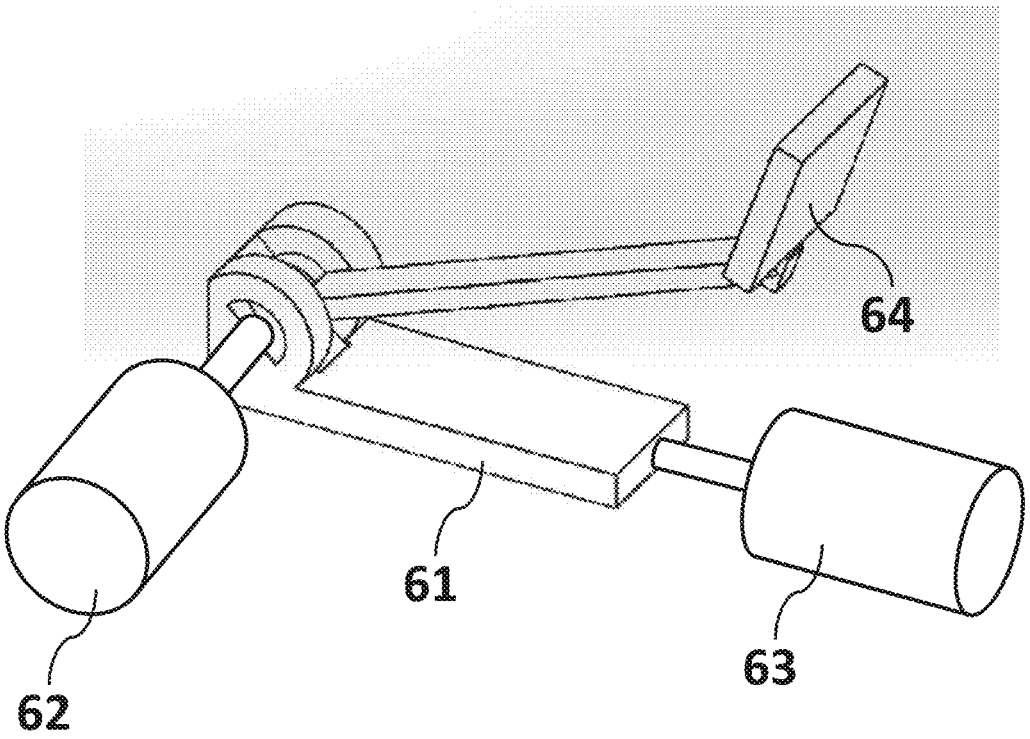
FIG. 6 is a non-limiting drawing showing an arm structure of the present invention that allows for single, parallel, and bidirectional (also known as scaffolding) fiber collection.

FIG. 6 is a non-limiting drawing showing an arm structure of the present invention that allows for single, parallel, and bidirectional (also known as scaffolding) fiber collection. Actuating controls may be adapted for positioning the arm structure and controlling motion to capture aligned fibers with precise separation during deposition on a substrate.

Figure 7:
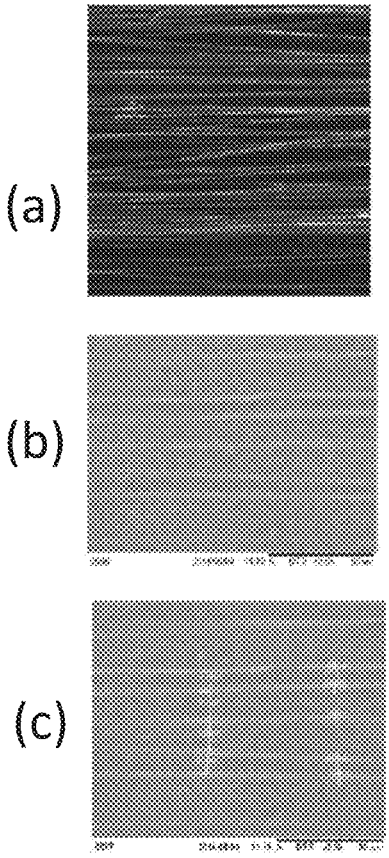
FIG. 7 is a non-limiting image that illustrates the controlled disposition of aligned fiber produced by the invention on round implant. (a) stereomicroscope image (8× magnification), (b) scanning electron microscope image (2000× magnification), (c) width and gap between adjacent fibers.

FIG. 7 is a non-limiting image that illustrates the controlled disposition of aligned fiber produced by the invention on round implant. (a) stereomicroscope image (8× magnification), (b) scanning electron microscope image (2000× magnification), (c) width and gap between adjacent fibers.

Figure 8:
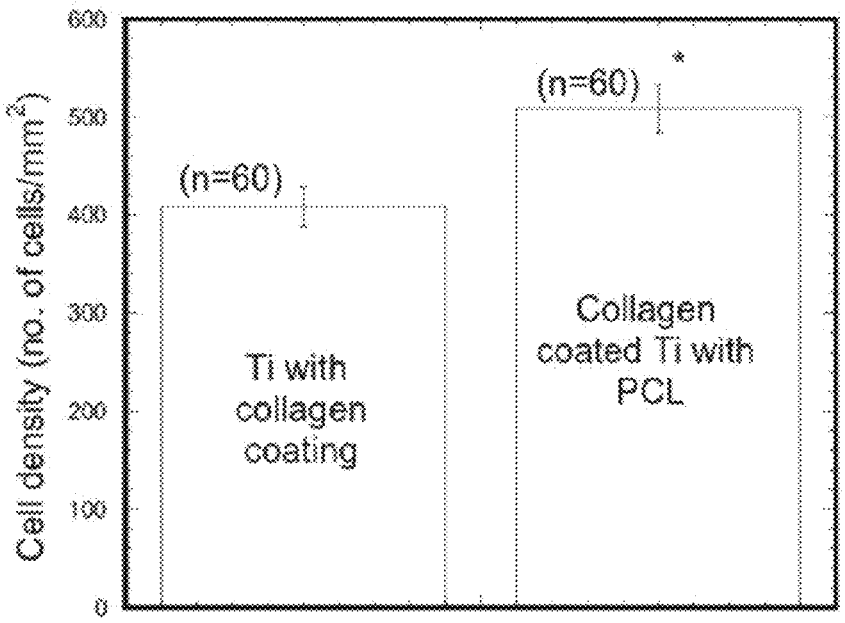
FIG. 8 is a non-limiting graph showing cell density on Ti samples after 2 weeks of cell culture.

FIG. 8 is a non-limiting graph showing cell density on Ti samples after 2 weeks of cell culture.

Figure 9:
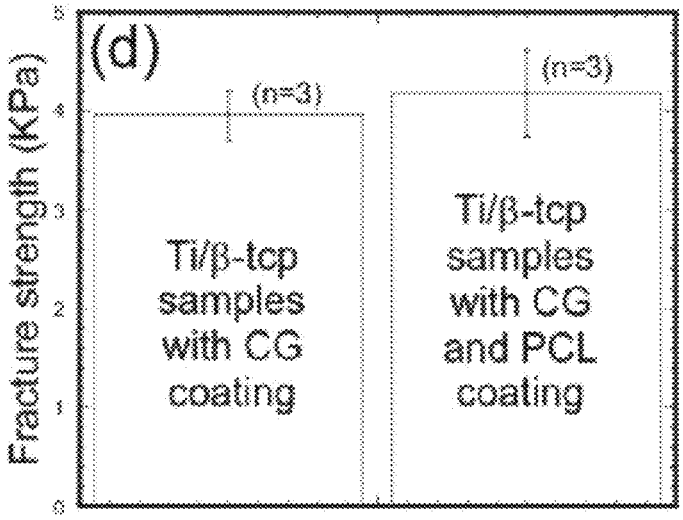
FIG. 9 is a non-limiting graph showing tensile test results of Ti/β-TCP samples.

FIG. 9 is a non-limiting graph showing tensile test results of Ti/β-TCP samples.

Figure 10:
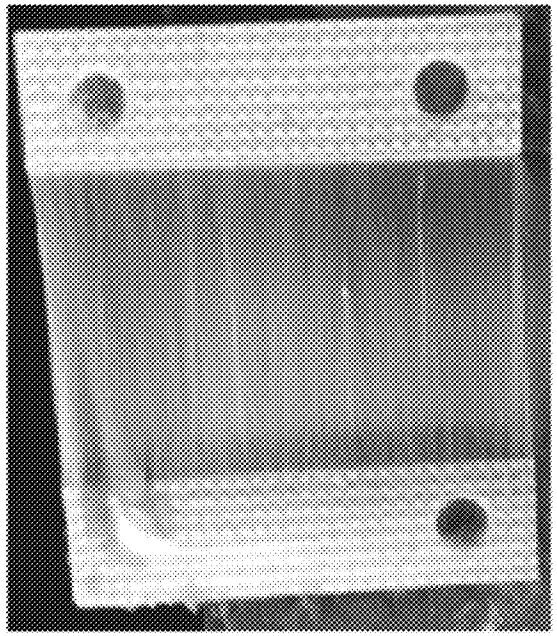
FIG. 10 is a non-limiting image showing aligned fiber between two parallel plates.

FIG. 10 is a non-limiting image showing aligned fiber between two parallel plates.

Figure 11:
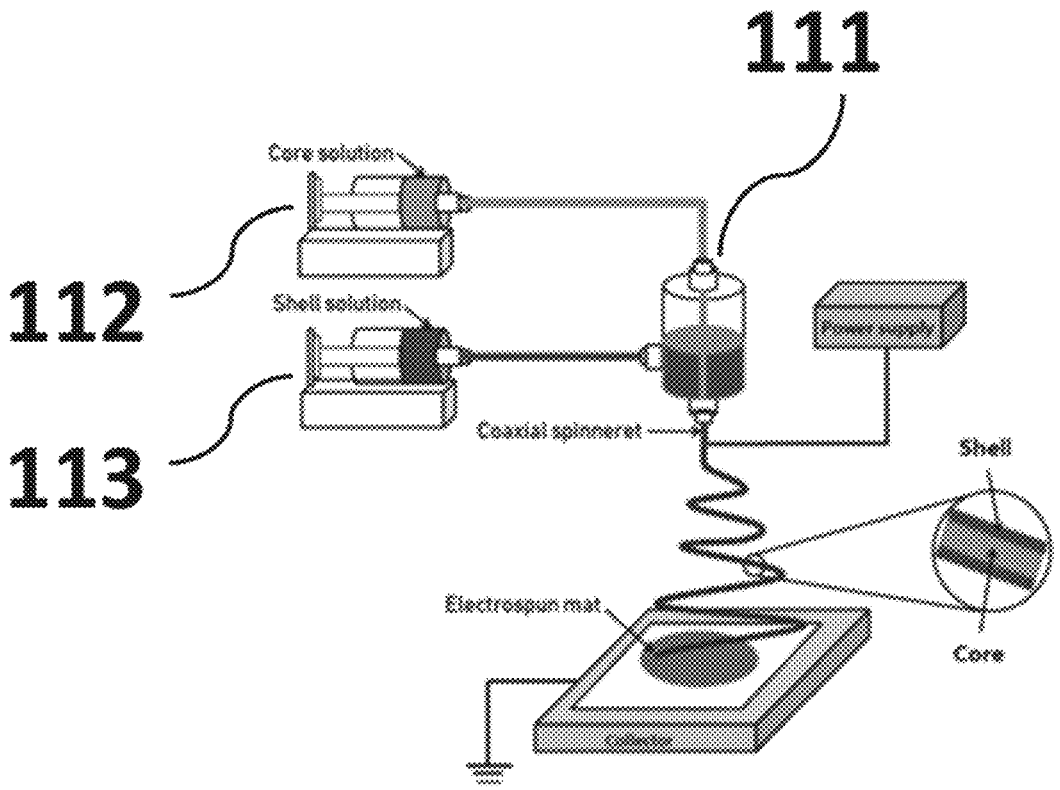
FIG. 11 is a non-limiting image showing a typical coaxial electrospinning setup.

FIG. 11 is a non-limiting image showing a typical coaxial electrospinning setup. The apparatus of the present invention can be configured to produce solid or core-shell nanofibers using electrospinning components similar to those shown. A core-shell configuration uses a coaxial nozzle comprising a central tube surrounded by a concentric circular tube. Two different polymer solutions are pumped into the coaxial nozzle separately, and ejected from the charged emitter simultaneously. A Taylor cone is formed when a high voltage is applied between the spinneret and the collector. Inner and outer solutions in the form of a jet are ejected towards a charged collector. The solvent in the solution jet evaporates, forming the core-shell nanofibers.

Figure 12:
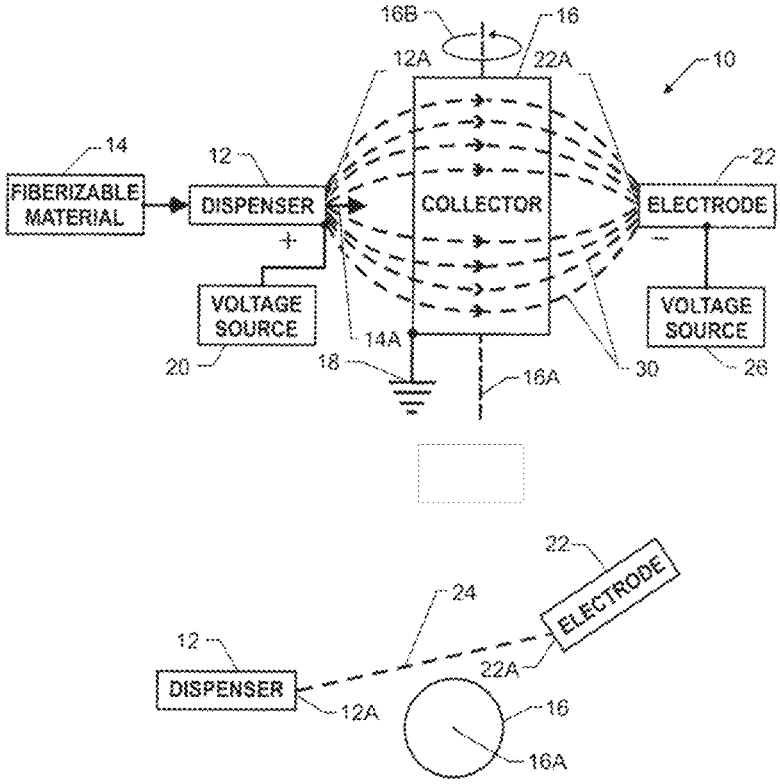
FIG. 12 is a non-limiting image showing the electrospinning apparatus developed by NASA and disclosed in U.S. Pat. No. 7,993,567.

FIG. 12 is a non-limiting image showing the electrospinning apparatus developed by NASA and disclosed in U.S. Pat. No. 7,993,567. The apparatus uses an auxiliary counter electrode to align fibers for control of the fiber distribution during the electrospinning process. The electrostatic force imposed by the auxiliary electrode creates a converged electric field, which affords control over the distribution of the fibers on the rotating collector surface. A polymer solution is expelled through the tip of the spinneret at a set flow rate as a positive charge is applied. An auxiliary electrode, which is negatively charged, is positioned opposite the charged spinneret. The disparity in charges creates an electric field that effectively controls the behavior of the polymer jet as it is expelled from the spinneret; it ultimately controls the distribution of the fibers and mats formed from the polymer solution as it lands on a rotating collection mandrel.

Figure 13:
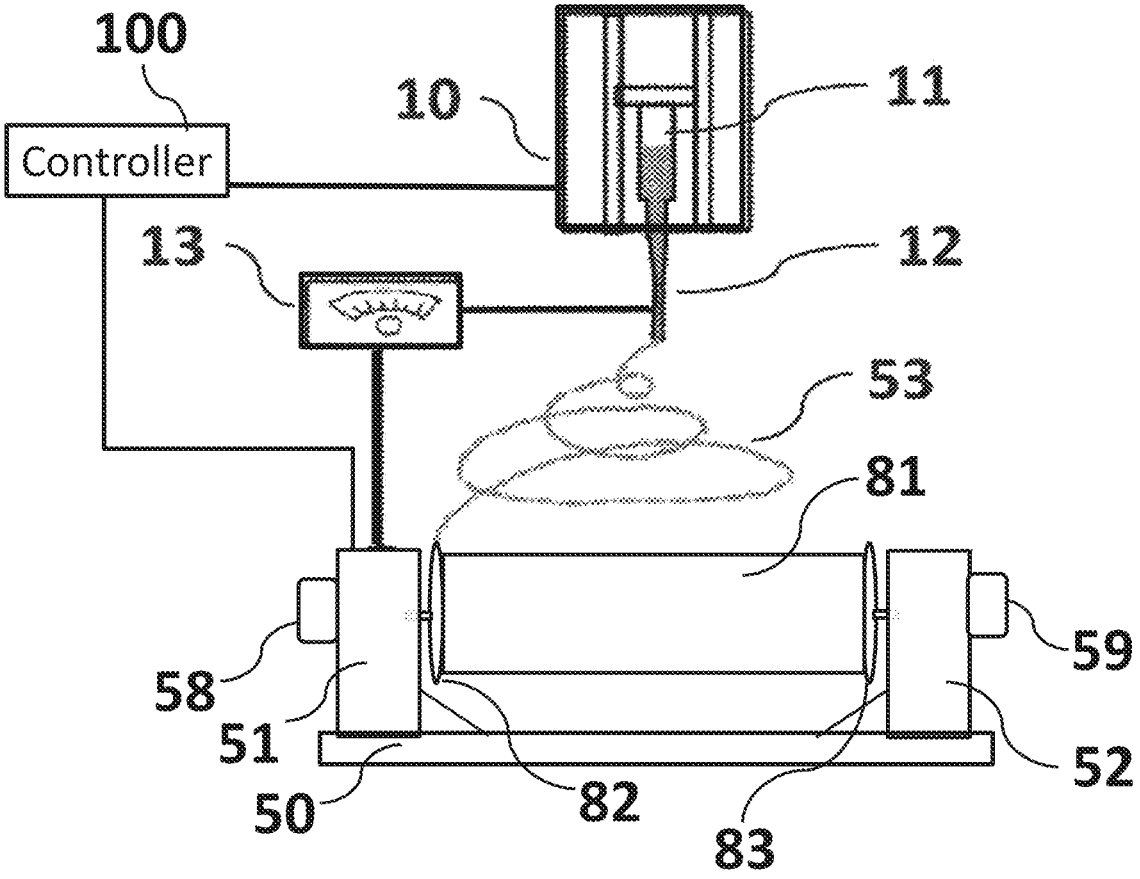
FIG. 13 is a non-limiting image showing a preferred embodiment of the present invention where the dual disk electrospinning apparatus disclosed in co-pending U.S. patent application Ser. No. 14/734,147 is adapted with a first segment (i.e., a disk), a second segment (i.e., a disk), and an intermediate segment (i.e., an elongated cylinder).
Figure 19:
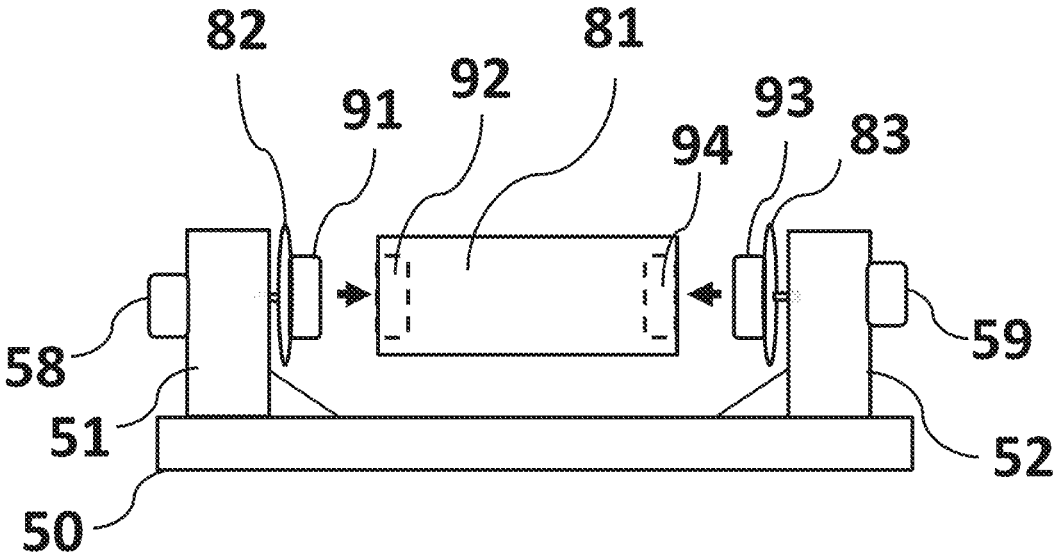
FIG. 19 is a non-limiting image showing a preferred embodiment of the present invention where the first segment (i.e., a disk) and the second segment (i.e., a disk), each rotationally mounted on a separate drive motor and moveably separable on a base mount, are adjusted to accept the intermediate segment between the first segment and the second segment (i.e., disks), and the intermediate segment (i.e., cylinder) connects to the first and second segments (i.e., disks) using insulating connectors.

FIG. 13 is a non-limiting image showing a preferred embodiment of the present invention where the dual disk electrospinning apparatus disclosed in co-pending U.S. patent application Ser. No. 14/734,147 is adapted with a first segment (i.e., a disk), a second segment (i.e., a disk), and an intermediate segment (i.e., an elongated cylinder). The intermediate segment connects to the first segment and the second segment using insulating connectors (FIG. 19). The first segment and the second segment are electrically chargeable. The intermediate segment can be charged, maintained electrically neutral, or at electrically grounded. The first segment and the second segment are mounted on separately controlled drive motors that are movably mounted on a base. The span between the first segment and the second segment may be increased to enable mounting the intermediate segment on the insulating connectors.

Figure 14:
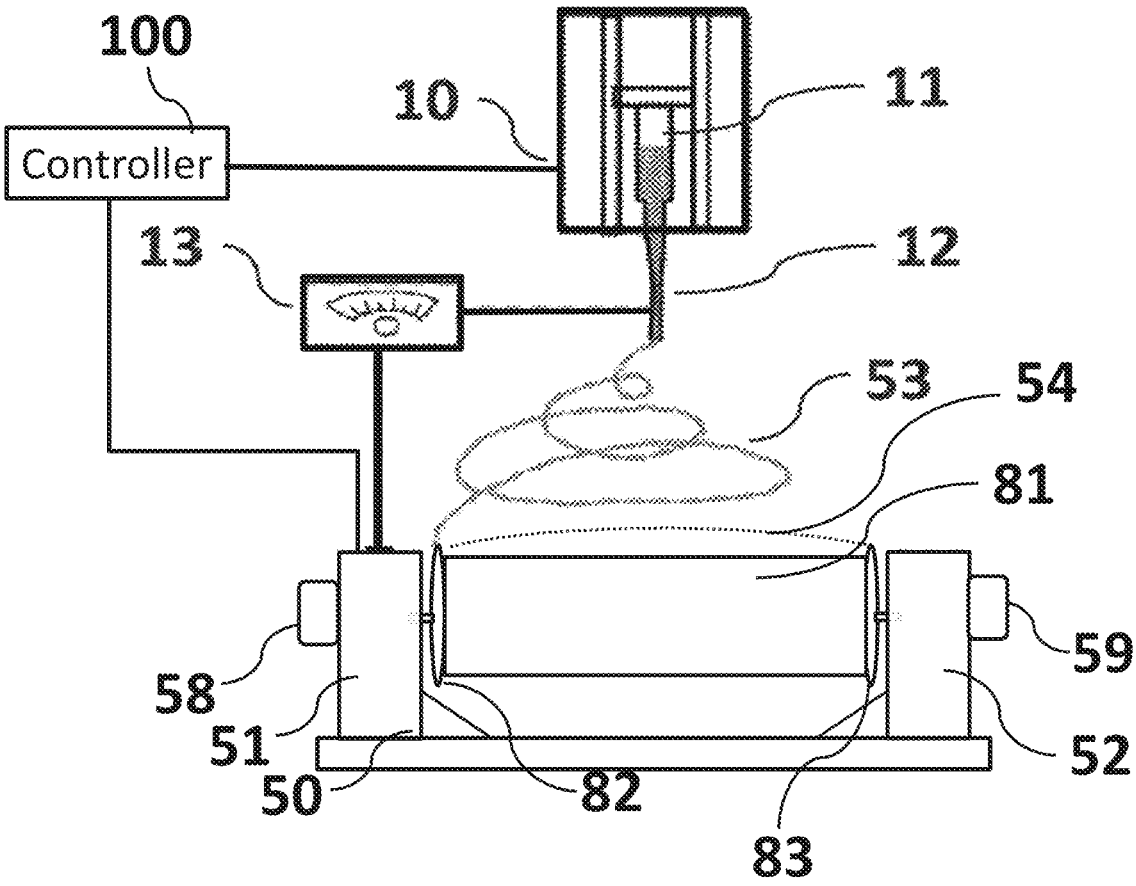
FIG. 14 is a non-limiting image showing a preferred embodiment of the present invention where a nanofiber is attached between the first segment (i.e., a disk) and the second segment (i.e., a disk), spanning across the length of the intermediate segment (i.e., an elongated cylinder).

FIG. 14 is a non-limiting image showing a preferred embodiment of the present invention where a nanofiber is attached between the first segment (i.e., a disk) and the second segment (i.e., a disk), spanning across the length of the intermediate segment (i.e., an elongated cylinder). The charged electrospun fiber is attracted to the first segment and the second segment which are charged at an opposite polarity with respect to the charged fiber. The whipping action characteristic of electrospun fibers causes the fiber to move back and forth, the fiber attaching circumferentially to the first segment and the second segment.

Figure 15:
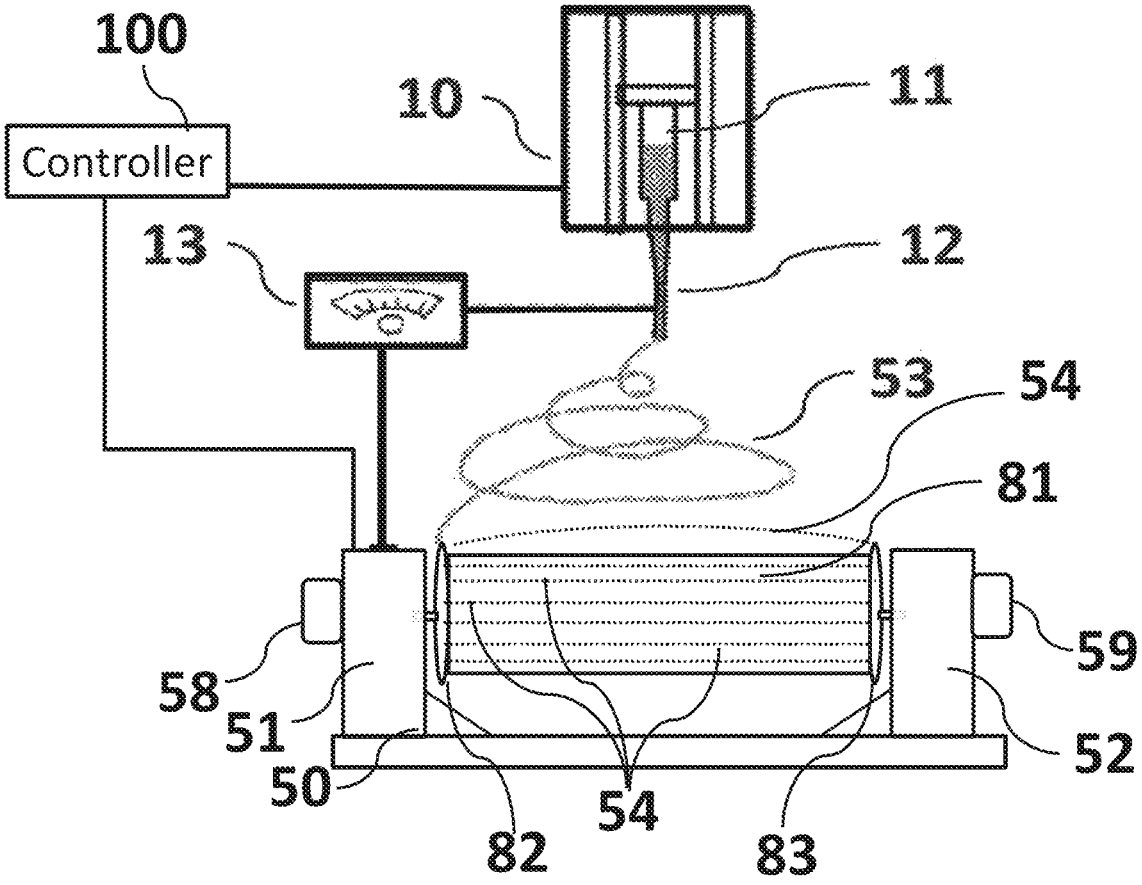
FIG. 15 is a non-limiting image showing a preferred embodiment of the present invention where a plurality of nanofibers is attached between the first segment (i.e., a disk) and the second segment (i.e., a disk), spanning across the length of the intermediate segment (i.e., an elongated cylinder).

FIG. 15 is a non-limiting image showing a preferred embodiment of the present invention where a plurality of nanofibers is attached between the first segment (i.e., a disk) and the second segment (i.e., a disk), spanning across the length of the intermediate segment (i.e., an elongated cylinder). The charged electrospun fiber is attracted to the first segment and the second segment which are charged at an opposite polarity with respect to the charged fiber. The whipping action characteristic of electrospun fibers causes the fiber to move back and forth the fiber attaching circumferentially to the first segment and the second segment. The first segment, the intermediate segment, and the second segment are collectively rotated by at least one drive motor about a longitudinal axis. Nanofibers attach at multiple points around the perimeter of the first segment and the second segment, spanning the separation space occupied by the intermediate segment.

Figure 16:
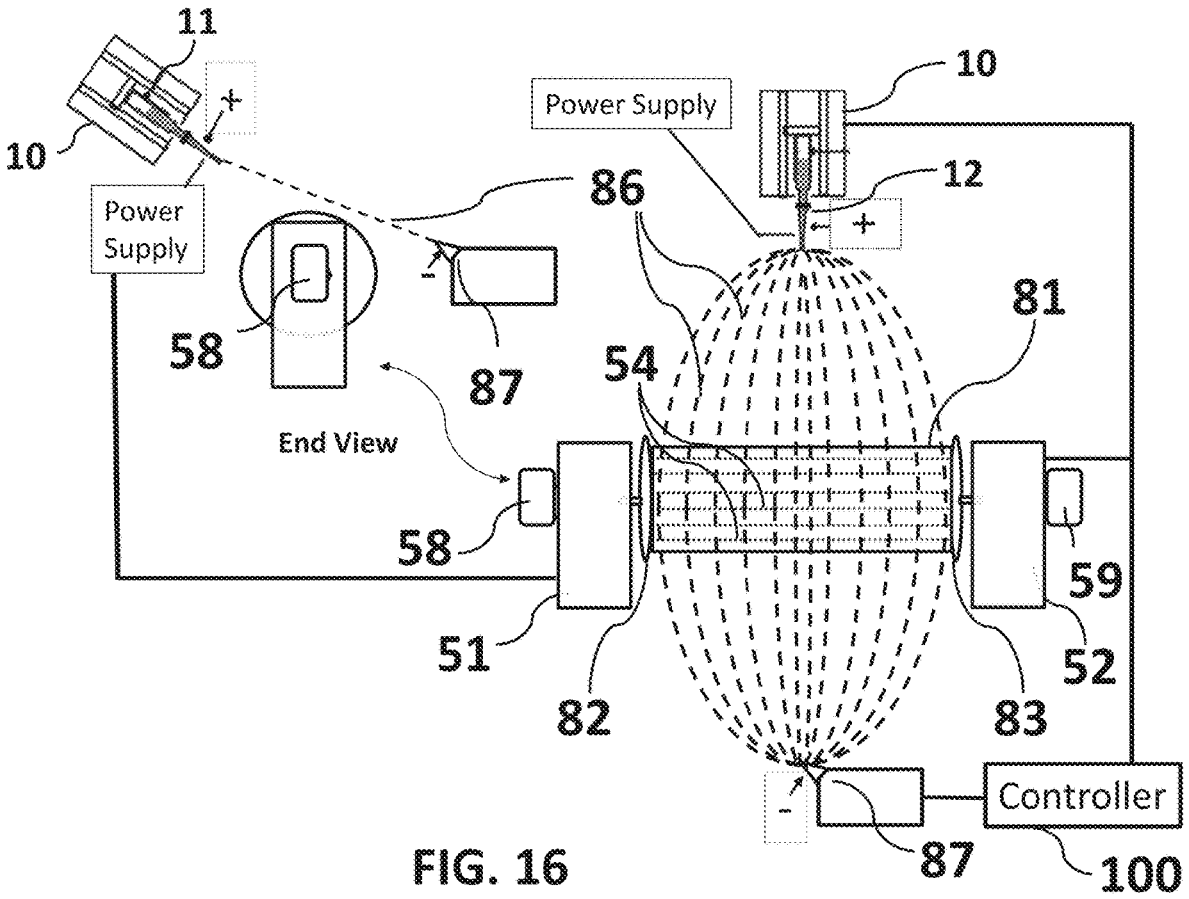
FIG. 16 is a non-limiting image showing a preferred embodiment of the present invention where a plurality of nanofibers is attached between the first segment (i.e., a disk) and the second segment (i.e., a disk), spanning across the length of the intermediate segment (i.e., an elongated cylinder), and a plurality of branched fibers are attracted between a charged emitter and an electrode having an opposing charge, the branched fibers spanning orthogonally across the nanofibers attached to the first and second segments.

FIG. 16 is a non-limiting image showing a preferred embodiment of the present invention where a plurality of nanofibers is attached between the first segment (i.e., a disk) and the second segment (i.e., a disk), spanning across the length of the intermediate segment (i.e., an elongated cylinder), and a plurality of branched fibers are attracted between a charged emitter and a steering electrode having an opposing charge, the branched fibers spanning orthogonally across and proximate to the nanofibers attached to the first and second segments. The emitter is configured for electrospinning nanoscale fiber streams comprising many charged fiber branches, can be electrically charged and has a tip positioned offset away from and between the edge of the first segment and the edge of the second segment. A support structure is provided for rotating the elongated assembly (first segment, second segment, and intermediate segment) about a longitudinal axis and no electrical charge is applied to the first segment and second segment while the steering electrode is electrically charged. The electrically chargeable steering electrode is provided for attracting the fiber streams along motion pathways substantially orthogonal to motion pathways of fiber streams attracted to the first and second segments spanning the intermediate segment. The fibers are attracted to the surface of the intermediate segment when it is electrically grounded.

Figure 17:
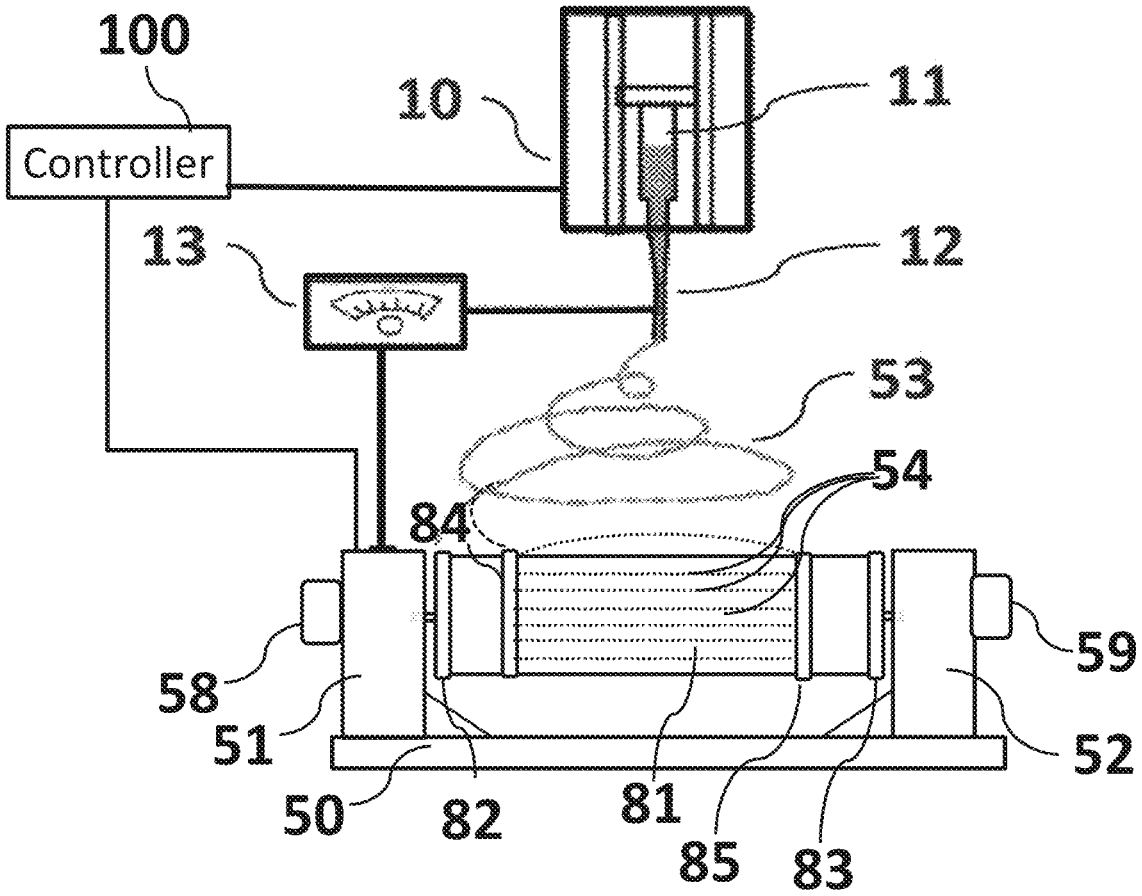
FIG. 17 is a non-limiting image showing a preferred embodiment of the present invention configured with a first segment (i.e., metallic ribbon), a second segment (i.e., metallic ribbon), a third segment (i.e., metallic ribbon), and a forth segment (i.e., metallic ribbon), where a plurality of nanofibers is attached between the third segment (i.e., metallic ribbon) and the fourth segment (i.e., metallic ribbon), spanning across the length of the intermediate segment (i.e., an elongated cylinder).

FIG. 17 is a non-limiting image showing a preferred embodiment of the present invention configured with a first segment (i.e., metallic ribbon), a second segment (i.e., metallic ribbon), a third segment (i.e., metallic ribbon), and a forth segment (i.e., metallic ribbon), where a plurality of nanofibers is attached between the third segment (i.e., metallic ribbon) and the fourth segment (i.e., metallic ribbon), spanning across the length of the intermediate segment (i.e., an elongated cylinder). The charged electrospun fiber is attracted to the third segment and the fourth segment, the first segment and the second segment being maintained in a neutral state. The third segment and the fourth segment are charged at an opposite polarity with respect to the charged electrospun fiber. The whipping action characteristic of electrospun fibers causes the fiber to move back and forth the fiber attaching to circumferentially to the third segment and the fourth segment. The first segment, third segment, intermediate segment, second segment, and fourth segment are collectively rotated by at least one drive motor about a longitudinal axis. Nanofibers attach at multiple points around the perimeter of the third segment and the fourth segment, spanning the separation space occupied by the intermediate segment.

Figure 18:
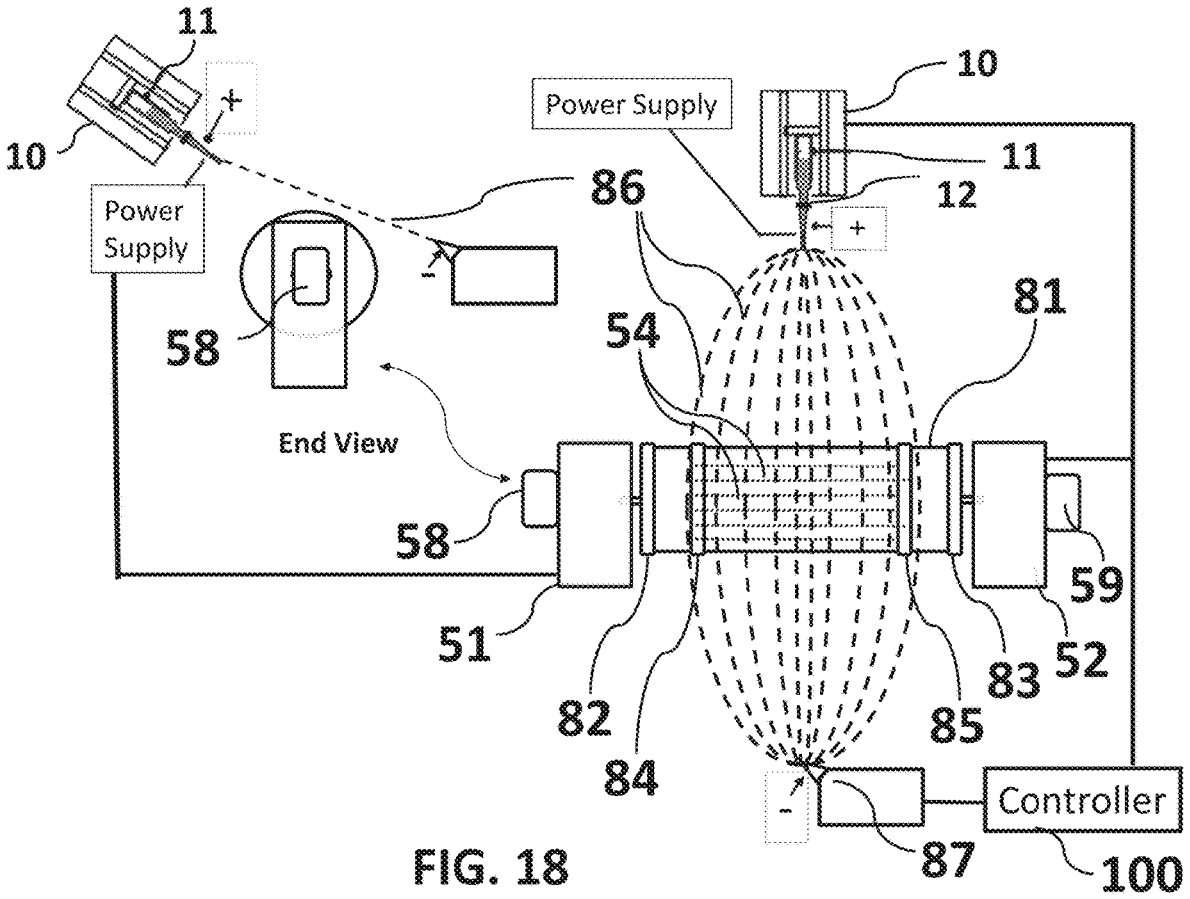
FIG. 18 is a non-limiting image showing a preferred embodiment of the present invention where a plurality of nanofibers is attached between the third segment (i.e., metallic ribbon) and the forth segment (i.e., metallic ribbon), spanning across the length of the intermediate segment (i.e., an elongated cylinder), and a plurality of branched fibers are attracted between a charged emitter and an electrode having an opposing charge, the branched fibers spanning orthogonally across the nanofibers attached to the third and fourth segments.

FIG. 18 is a non-limiting image showing a preferred embodiment of the present invention where a plurality of nanofibers is attached between the third segment (i.e., metallic ribbon) and the forth segment (i.e., metallic ribbon), spanning across the length of the intermediate segment (i.e., an elongated cylinder), and a plurality of branched fibers are attracted between a charged emitter and an electrode having an opposing charge, the branched fibers spanning orthogonally across the nanofibers attached to the third and fourth segments. The emitter is configured for electrospinning nanoscale fiber streams comprising many charged fiber branches, can be electrically charged and has a tip positioned offset away from and between the edge of the first segment and the edge of the second segment. A support structure is provided for rotating the elongated assembly (first segment, second segment, third segment, fourth segment, and intermediate segment) about a longitudinal axis and no electrical charge is applied to the first segment, second segment, third segment, or fourth segment while the steering electrode is electrically charged. The electrically chargeable steering electrode is provided for attracting the fiber streams along motion pathways substantially orthogonal to motion pathways of fiber streams attracted to the third and fourth segments spanning the intermediate segment. The fibers are attracted to the surface of the intermediate segment between the third and fourth segments when it becomes electrically grounded.

FIG. 19 is a non-limiting image showing a preferred embodiment of the present invention where the first segment (i.e., a disk) and the second segment (i.e., a disk), each rotationally mounted on a separate drive motor and moveably separable on a base mount, are adjusted to accept the intermediate segment between the first segment and the second segment (i.e., disks), and the intermediate segment (i.e., cylinder) connects to the first and second segments (i.e., disks) using insulating connectors. The first segment and the second segment are electrically chargeable. The intermediate segment can be charged, maintained electrically neutral, or electrically grounded. The first segment and the second segment are mounted on separately controllable drive motors that are movably mounted on a base. The span between the first segment and the second segment may be increased to enable mounting the intermediate segment on the insulating connectors. The span is reduced to secure the intermediate segment in operating position. Intermediate segments of differing lengths may be selected and installed between the first segment and the second segment to produce nanofiber membranes of corresponding width.

Figure 20:
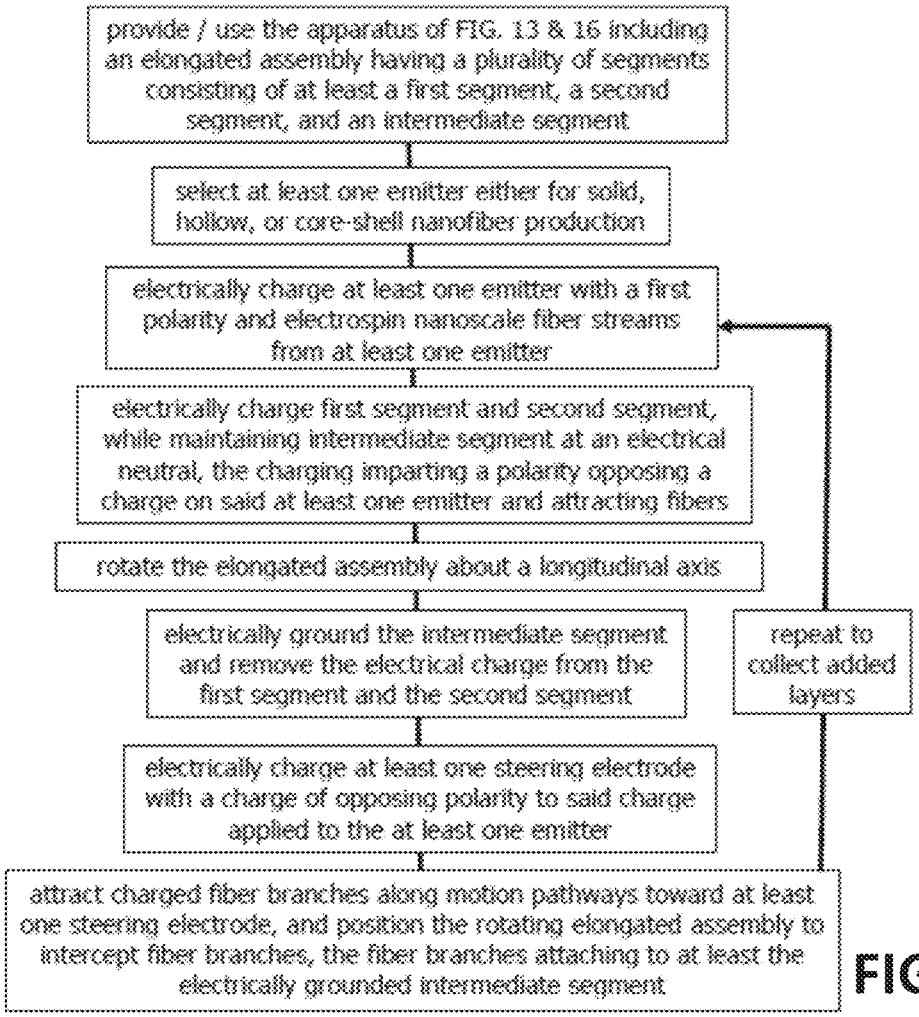
FIG. 20 is a non-limiting image showing a method of the present invention for fabricating a cross-aligned nanofiber membrane usable in constructing at least a layered wound care dressing dressing, a tissue engineering scaffold, a medical grade air filter, and protective fabrics.

FIG. 20 is a non-limiting image showing a method of the present invention for fabricating a cross-aligned nanofiber membrane usable in constructing at least a layered wound care dressing, Nanoscale fiber streams are electrospun from at least one emitter, the fiber streams comprising many charged fiber branches, the at least one emitter being electrically charged and having a tip positioned offset away from and between the first segment and the second segment. The first segment and the second segment are charged by applying a voltage having a first polarity, while maintaining the intermediate segment at one of an electrical neutral or electrical ground, the charging imparting a polarity opposing a charge on the at least one emitter realizing an electrical potential difference. The elongated assembly is rotated about a longitudinal axis, and the charged fiber branches are attracted by the opposing electrical charge on a circumferential edge of the first segment and the second segment, where the fibers alternately attach to the circumferential edge of the first segment and the second segment, spanning a separation distance between the first segment and the second segment. The intermediate segment is maintained electrically neutral, and set to electrical ground when the electrical charge is removed from the first segment and the second segment. Cross-aligned fibers are applied to a fiber layer on the intermediate segment spanning the separation distance between the first segment and the second segment by rotating the elongated assembly and electrically charging at least one steering electrode with a charge exhibiting an opposing polarity to the charge applied to the at least one emitter producing a charged fiber stream. Branch fibers separate along field lines in the electromagnetic field produced by the opposing electrical charges applied to the at least one emitter and the at least one electrode, and the charged fiber branches attach circumferentially to at least the intermediate segment, the intermediate segment being electrically grounded.

Figure 21:
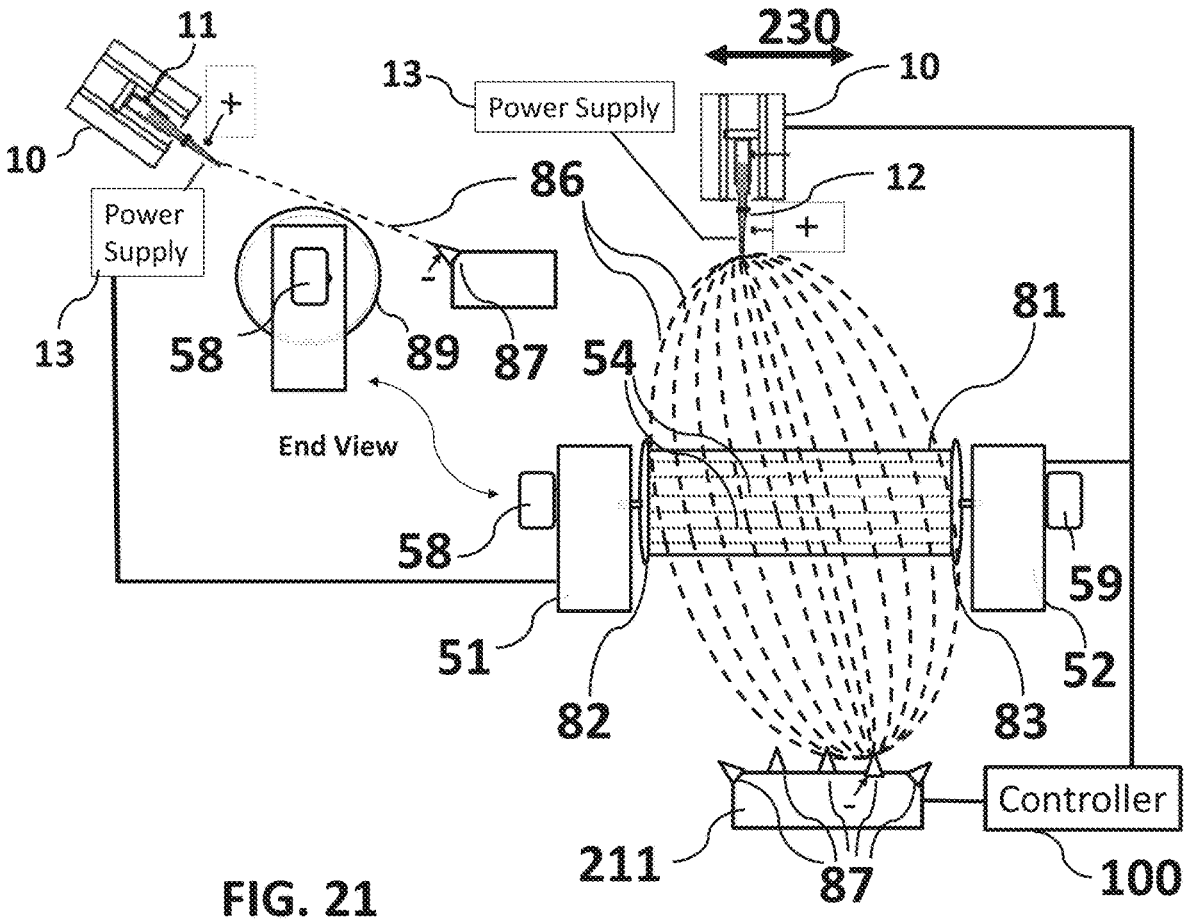
FIG. 21 is a non-limiting image showing a preferred embodiment of the present invention configured with a plurality of steering electrodes.

FIG. 21 is a non-limiting image showing a preferred embodiment of the present invention configured with a plurality of steering electrodes. The steering electrodes may be programmably chargeable so that motion pathways of branched fiber streams toward the electrodes from the at least one emitter is alterable.

Figure 22:
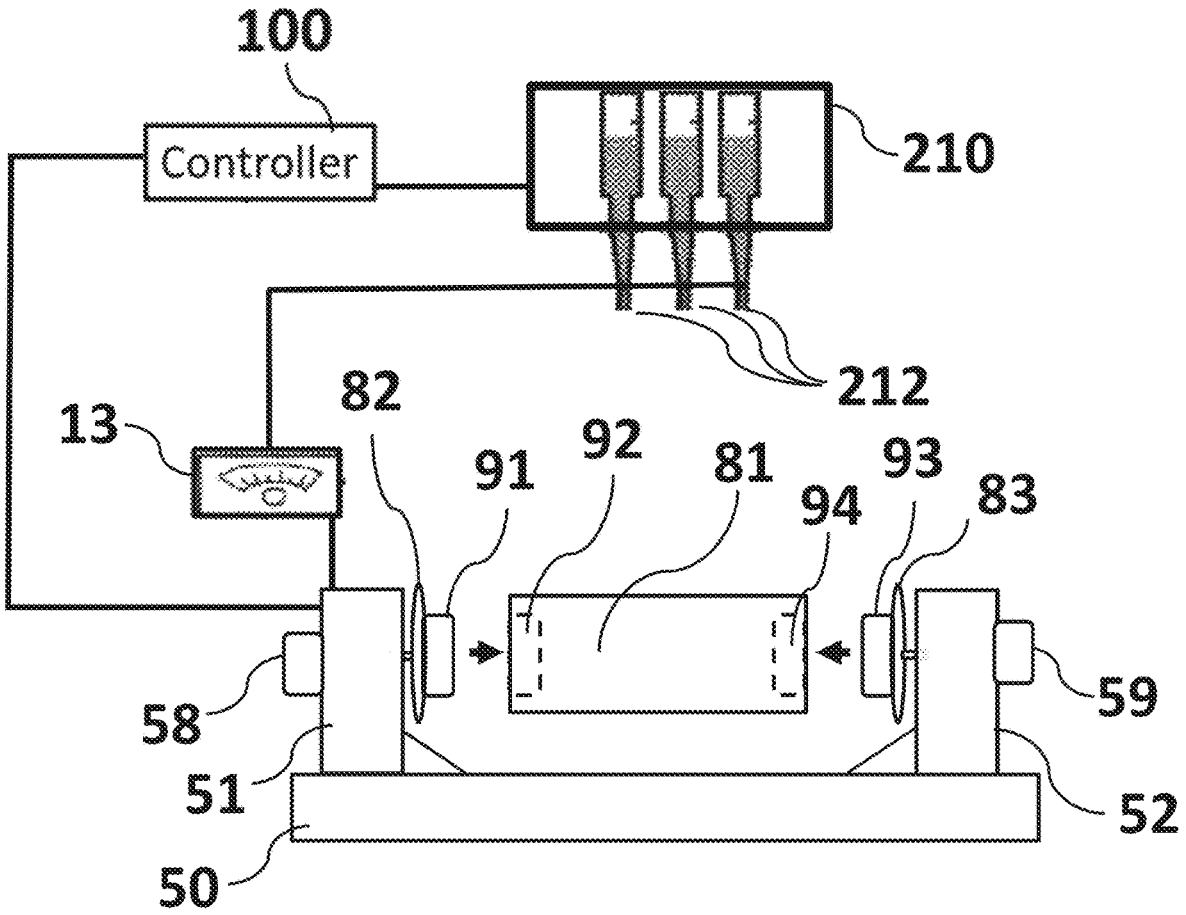
FIG. 22 is a non-limiting image showing a preferred embodiment of the present invention where a plurality of emitters.

FIG. 22 is a non-limiting image showing a preferred embodiment of the present invention where a plurality of emitters is configured in an emitter assembly. Multiple fiber types, including but not limited to solid and core-shell, may be electrospun by configuring the emitter assembly with multiple emitters as shown. The chemical composition of the fibers electrospun from each emitter in the emitter assembly may differ.

In Detail:

Referring now to FIG. 1 a non-limiting diagram schematically illustrates the method of a typical electrospin process, aspects of which are included in the present invention. A typical electrospin setup consists of syringe pump, syringe with a needle, high-voltage power supply, and collector. Typically, a single rotating or flat target disk, a pair of charged collector strips have been used as the fiber collector. Rotating drums are also used to collect fiber.

Referring now to FIG. 2, a non-limiting diagram is shown schematically illustrating the single disk method of the present invention. The embodiment shown in the diagram uses the path of the electromagnetic field 33 generated by the potential difference between charged needle 12 and rotating auxiliary metallic disk 15 using a high-power voltage source 13 to capture, deposit and align fiber 31 on a substrate 40, 50, 60. The substrates 40, 50, and 60 may comprise relatively round 40 or irregular 50 or flat 60 shapes. A blunt headed bolt 21 may be used to attach two insulating washers 22 and 23 with the shaft of the motor. The auxiliary thin metallic disk 15 pulls away fibers by applying an opposed charge. The spinning primary collector shapes 40, 50, 60 intercept outer band fiber branch and coats a mounted shape 40, 50, 60 with aligned fibers. The diameter of the washers can be changed which may affect the amount of inside branches.

Referring now to FIG. 3, a non-limiting diagram illustrates components for the single disk configuration of the apparatus of the present invention. The electrospin chamber 20 housed the adjustable non-conducting support with the syringe needle 12, and the primary collector 17 and auxiliary disk 15. The embodiment shown in the diagram includes an infusion pump 10, syringe 11, syringe needle 12, an electric power supply 13, a rotating auxiliary metallic disk 15, and a primary collector shape 17. The metallic disk 15 is positioned in line with the syringe needle 12, and configured having two insulating washers (back washer is not shown, front washer is shown in FIG. 2, 22) attached using a metallic fastener (FIG. 2, 21), e.g., bolt adapted to engage (e.g., screwed into) a metal shaft (FIG. 2,24). The metallic fastener is electrically grounded. The primary collector shape 17 rotates on an axis substantially orthogonal to the rotational axis of the auxiliary metallic disk 15. The metallic disk 15 and the primary collector shape 17 are spun using speed controlled, direct current (DC) motors 14 and 16. The syringe needle 12 is electrically charged by applying a high-voltage in the range of (5 KVA to 15 KVA) produced by the power supply 13. An opposed charge is applied to the rotating disk 15 by applying a high-voltage in the range of (5 KVA to 15 KVA) generated by the power supply 13. The axis of rotation for the collector shape 17 can be repositioned by moving adjusters using a linear stage 18, which is pushed back and forth by a linear actuator 19.

Referring now to FIG. 4, a non-limiting diagram shows in single disk configuration a schematic view of the invention method. The auxiliary metallic disk 15 configured having two insulating washers 22 and FIG. 2-23 attached using a metallic fastener (e.g., bolt) 21 adapted to engage (e.g., screwed into) a metal shaft 24. The metallic bolt 21 is electrically grounded. A primary collector shape 40 rotates on rotational axis 196 substantially orthogonal to the rotational axis 194 of the auxiliary metallic disk 15. The present invention uses the auxiliary metallic disk 15 to pull away fibers from fiber streams FIG. 2-30 and FIG. 2-33 by applying an opposed charge to produce elongated unidirectional fibers FIG. 2-31. The opposed charge on the metallic disk 15 and the charge on the needle 12 may be generated by the power supply 13. Fiber FIG. 2-31 directed towards the circumference of a primary collector shape 40 or 50 or 60 may be utilized to deposit a continuous single strand fiber FIG. 2-31 on a relatively round 40 or irregular 50 or flat 60 shapes that can be mounted on the shaft 25 of the speed control motor FIG. 3-16. The shaft 25 is electrically grounded. A primary collector shape 40 is fastened with the shaft of the speed control motor (FIG. 3-6) and positioned to intercept an outer band single strand fiber FIG. 2-31 in the electromagnetic field (shown as dashed lines FIG. 2), which coats the shapes with aligned fiber. The position of the collector shapes 40 or 50 or 60 may be altered to move the axis of rotation 196 toward or away from the plane of the electromagnetic field (dashed lines) using a linear stage FIG. 3-18 pushed back and forth by a linear actuator FIG. 3-19. The position of the syringe needle 12 may be adjusted to increase or decrease the distance between the needle tip and the edge of the metallic disk 15 by the non-conducting support (e.g., wooden or plastic bar) FIG. 3-9 that is fastened to the sealable chamber FIG. 3-20. The DC motor (FIG. 3, 14) may be used to spin the metallic disk 15 about its axis of rotation 194. Using the present invention, an uninterrupted direct application of aligned fibers can be applied to a variety of target samples mounted on the motor shaft 25. The target samples may be any of a plurality of shapes and structures, including those typical of biomedical implants, biomaterial interfaces and tissue engineering scaffolds. The insulating washers 22 and FIG. 2-23, fastener 21 (e.g., bolt head) and primary collector shape 17 (e.g., specimen holder) of the present invention is adaptable to achieve different coating topography on the target (e.g., an implant) surface mounted on the motor shaft 25, and control of the deposition of the branches of the fibers to provide uniform distribution of the fiber FIG. 2-31 on the collector shapes 40 or 50 or 60.

The applied coat of aligned fiber on an implant can induce and improve aligned cell arrangements, including elongated unidirectional cell alignment.

Referring now to FIG. 5A, a non-limiting diagram shows a schematic view of the dual rotating disks configuration of the present invention that can be used to implement the method of controlling fiber alignment and deposition. The present invention provides a dual disk method, using a first disk 51 and a second disk 52 that incorporates the advantages of the electric field of the single disk method. The first disk 51 may be mounted on the rotational shaft of a first disk-speed control motor 58 and the second disk 52 may be mounted on the rotational shaft of a second disk-speed control motor 59. Benefits of configuring two disks 51 and 52 as in the present invention include a least the ability to control the length of each fiber, rapidly collect parallel fibers of the same length, and the capability of single fiber collection.

Referring now to FIG. 5B, fiber control is accomplished similarly to the single disk collection method, but instead of attracting the fibers 53 to the center of a single disk the fibers 53 are forced to the sharp edge of the disk (e.g. disk 51). This is accomplished by taking advantage of the electromagnetic field of a thin solid disk near the edge. The field lines of a point charge both positive and negative produce the path of strongest attraction. The two rotating disks 51 and 52 take advantage of the natural oscillation of the nanofiber 53, and in a manner similar to the parallel plate collection method. Giving the negatively charged disks the ability to rotate and tilt produces cross-linking (stray fibers) and the arcing effect of static charge, respectfully. The fibers 53 are allowed to follow random trajectories until they hit the electro-magnetic field of the disk (e.g., the first disk 51). At that point the fibers 54 align back and forth along a plain that intersects both disks. The disks 51 and 52 are mirrored and adjusted to capture fibers (FIG. 5C-55) of the desired length, with both disks 51 and 52 being negatively charged. Due to the fibers 53 grounding out on the first disk 51 and sharing the same charge, along with the effects of the electro-magnetic field, there is an arcing effect causing the fiber 54 to connect to the second disk 52. This effect is adjusted in shape by introducing a slight angle to both disks 51 and 52 in opposite directions so the tops of the disks 51 and 52 are closer together and the bottom of the disks 51 and 52 are slightly further apart, which stretches each connected fiber (FIG. 5C-55).

Referring now to FIG. 5C, by synchronized spinning of the disks 51 and 52 using the disk-speed control motors 58 and 59, the fibers 54 are pulled tight at the lower side of the disks 51 and 52 as stretched fibers 55, where the fibers 55 may be collected with greater control. Fiber-length may be adjusted by increasing or decreasing the linear separation distance between the first disk 51 and the second disk 52 by adjusting the separation position of the disk-speed control motors 58 and 59 on the base platform 50.

Referring now to FIG. 5D, a collection substrate 56 is shown positioned in the path of the fibers 55 stretched between the rotating disks 51 and 52. Once the fibers 54 have been optimized by stretching between the lower part of the disks 51 and 52, a collection shape 56 may be manipulated within the pathway of the stretched fibers 55. This can be done several different ways. The method with the most options would be implementing an arm structure 57 with variable control (angular, linear, along with extended rotational ability) as illustrated in FIG. 6. The arm structure 57 presented (see FIG. 6) allows for single, parallel, and bidirectional (also known as scaffolding) fiber collection. Scaffolding structures (non-woven) may be constructed by first placing the collection shape 56 in a first orientation in the pathway of the fibers 55 as shown in FIG. 5D. Multiple fibers may be collected as disks 51 and 52 are rotated by the disk-speed control motors 58 and 59, respectively, and the collection shape is incrementally repositioned by actuating controls (see FIG. 6) relative to path of the fibers 55. Subsequently, the collection shape 56 may be placed in a second orientation (e.g. rotated 90 degrees) in the pathway of the fibers 55. Multiple fibers may be collected as disks 51 and 52 are rotated by the disk-speed control motors 58 and 59, respectively, and the collection shape is incrementally repositioned by actuating controls (see FIG. 6). The second orientation may be achieved by rotating the collection shape substantially 90 degrees in the same plane with respect to the first orientation, producing a crossing pattern of fibers on the collection shape 56. Different crossing-patterns may be accomplished by varying the rotation angle. Multiple layers of fibers may also be collected and the crossing-patterns on the collection shape 56, controlled.

Referring now to FIG. 5E, a turn program 590 created using Labview is presented. To control the linear actuator motor a PWM (Pulse width modulation) circuit can be created. In developing the actuator controls for the present invention the tool used to create the PWM was Labview. A square signal was generated and transferred to a National Instruments Corp. (NI) tool called a MyDAQ. The MyDAQ transferred the signal to the PWM circuit enabling motor control. This paired with a linear actuating arm gave way to aligned fibers on a substrate that could be controlled very precisely. NI myDAQ combines hardware with eight ready-to-run software-defined instruments, including a function generator, oscilloscope, and digital multimeter (DMM); these software instruments are also used on the NI Educational Laboratory Virtual Instrumentation Suite II (NI ELVIS II) hardware platform. LabVIEW software can be combined with modular, reconfigurable hardware to produce precise actuator and motor control.

Referring now to FIG. 6, a non-limiting drawing shows an arm structure 61 of the present invention that allows for single, parallel, and bidirectional (also known as scaffolding) fiber collection. Actuating controls (62 and 63) may be adapted for positioning the arm structure 61. The arm structure 61 may be a fixed arm, include an arch stand, comprise belt stands, and incorporate rotating structural components. A fiber collection surface 64 may be rotationally mounted on the arm structure 61 as shown or in alternate positions. The arm structure 61 may be configured with at least one actuating control 62 or 63 to manipulate positioning of the structure for collecting fiber, including rotational positioning and linear positioning. Actuating controls 62 and 63 may be adapted for positioning a variety of structures and fiber collection substrates using industry standard motion control methods and processes directed to computer control of robotic instruments. For example, the motion may be controlled by a linear actuator, such as those available from Newport Corporation (model #LTA-HS) to produce aligned uni-direction fiber on a fiber collection surface 64. The fibers produced may be deposited on a collection surface 64 attached to the arm structure 61. r actuating arm gave way to aligned fibers on a substrate that could be controlled very precisely.

Referring now to FIG. 11, a non-limiting image shows a typical coaxial electrospinning setup. The apparatus of the present invention can be configured with an emitter 12 to produce solid fibers as shown in FIG. 5A, or a coaxial emitter 111 to produce core-shell nanofibers using components similar to those shown FIG. 11. A core-shell configuration uses a coaxial nozzle comprising a central tube surrounded by a concentric circular tube. Two different polymer solutions are pumped into the coaxial nozzle separately, and ejected from the charged emitter simultaneously. A Taylor cone is formed when a high voltage is applied between the spinneret and the collector. Inner and outer solutions in the form of a jet are ejected towards a charged collector. The solvent in the solution jet evaporates, forming the core-shell nanofibers. Emitters and associate components for use in electrospinning core-shell nanofibers are commercially available from sources such as Linari Nano-Tech, Italy.

FIG. 12 is a non-limiting image showing the electrospinning apparatus developed by NASA and disclosed in U.S. Pat. No. 7,993,567. The apparatus uses an auxiliary counter electrode to align fibers for control of the fiber distribution during the electrospinning process. The electrostatic force imposed by the auxiliary electrode creates a converged electric field, which affords control over the distribution of the fibers on the rotating collector surface. A polymer solution is expelled through the tip of the spinneret at a set flow rate as a positive charge is applied. An auxiliary electrode, which is negatively charged, is positioned opposite the charged spinneret. The disparity in charges creates an electric field that effectively controls the behavior of the polymer jet as it is expelled from the spinneret; it ultimately controls the distribution of the fibers and mats formed from the polymer solution as it lands on a rotating collection mandrel. The NASA apparatus designed to produce pseudo-woven mats by electrospinning multiple layers in a 0°/90° lay-up. This is achieved by electrospinning the first layer onto a polymer film such as Kapton® attached to the collector, removing the polymer film, rotating it 90°, reattaching it to the collector and electrospinning the second layer on top of the first, resulting in the second layer lying 90° relative to the first layer. To produce a thicker pseudo-woven mat, the lay-up procedure must be repeated multiple times in each direction) (0°/90° for a period of at least 30-60 seconds for each orientation. The required and repeated step of removing the polymer film, rotating it 90°, reattaching it to the collector and electrospinning the second layer on top of the first is a major deficiency in the method and apparatus developed by NASA when considered from the perspective of cost-effective commercial production of cross-aligned nanofiber membranes. The present invention overcomes this major deficiency, while incorporating aspects of the NASA apparatus.

Referring now to FIG. 13, a non-limiting image shows a preferred embodiment of the present invention where the dual disk electrospinning apparatus disclosed in co-pending U.S. patent application Ser. No. 14/734,147 is adapted with an elongated assembly comprising a plurality of collector segments including at least the first segment 82 (i.e., a disk), a second segment 83 (i.e., a disk), and an intermediate segment 81 (i.e., an elongated cylinder). The first segment 82 is positioned at one end of the intermediate segment 81 and the second segment 83 is positioned at an opposite end of the intermediate segment 81. The intermediate segment 81 connects to the first segment 82 and the second segment 83 using insulating connectors (91 & 93 FIG. 19). The first segment 82 and the second segment 83 are electrically chargeable and present a circumferential edge to electrospun nanofibers. The intermediate segment 81 can be maintained electrically neutral or at electrical ground. The first segment 82 and the second segment 83 are mounted on separately controlled drive motors (58 and 59) that are movably mounted on a base 50. The span between the first segment 82 and the second segment 83 may be increased to enable mounting the intermediate segment on the insulating connectors (91 & 93, FIG. 19). At least one emitter 12 is configured for electrospinning nanoscale fiber streams comprising many charged fiber branches. The pump 10 may be configured with one or two reservoirs to hold polymer solutions. The at least one emitter 12 can be electrically charged and has a tip positioned offset away from and between the edge of the first segment 82 and the edge of the second segment 83. The at least one emitter 12 may be configured to produce solid fibers (FIG. 5A-12). The at least one emitter 12 may be configured to produce core-shell fibers (FIG. 11-111). Emitters (a.k.a., spinnerets, needles) for electrospinning coaxial nanofibers are commercially available from sources such as ramé-hart instrument co., Succasunna, N.J. The primary modification to the electrospinning configuration shown in FIG. 5A relies on the use of two syringes for pumping polymer solutions, and the type of spinneret employed and which typically consists of a pair of capillary tubes where a smaller one is inserted (inner) concentrically inside a larger (outer) capillary to structure a co-axial configuration. Each capillary tube is connected to a dedicated reservoir containing solutions independently supplied by a syringe-pump or air pressure system. For example, two syringe pumps (see FIG. 11) can be used to impulse both solutions provided to a coaxial spinneret, which presents two inputs. Inside this coaxial spinneret 12 both fluids flow into the tip of the device where the injection of one solution into another produces a coaxial stream. The shell fluid drags the inner one at the Taylor cone of the electrospinning jet. Both polymer solutions are connected to a high-voltage source 13 and a charge accumulation forms on the surface of the shell solution liquid. The liquid compound meniscus of the shell liquid elongates and stretches as a result of charge-charge repulsion. This forms a conical shape (Taylor cone). The charge accumulation increases to a certain threshold value due to the increased applied potential, at that point a fine jet extends from the cone. Stresses are generated in the shell solution that cause shearing of the core solution via "viscous dragging" and "contact friction." Shearing causes the core liquid to deform into a conical shape and a compound co-axial jet develops at the tip of the cones. Provided the compound cone remains stable, a core is uniformly incorporated into the shell producing a core-shell fiber formation. As the core-shell fiber moves toward a collector (e.g., 82 & 83), the jet experiences bending instability, producing a back and forth whipping trajectory and the two solvents in the core-shell stream evaporate, and core-sheath nanofibers are formed. A support structure holding drive motors (58 & 59) as part of the base 50 is provided for rotating the elongated assembly about a longitudinal axis and applying an electrical charge to at least the first segment 82 and second segment 83.

Referring now to FIG. 14, a non-limiting image shows a preferred embodiment of the present invention where a nanofiber 54 is attached between the first segment 82 (i.e., a disk) and the second segment 83 (i.e., a disk), spanning across the length of the intermediate segment 81 (i.e., an elongated cylinder). Controller 100 governs the charge status of the at least one emitter 12, first segment 82, second segment 83, and intermediate segment 81, as well as the polymer flow rate, and rotation speed of the elongated assembly. The charged electrospun fiber 54 is attracted to the first segment 82 and the second segment 83 which are charged at an opposite polarity with respect to the charged fiber 54. The whipping action characteristic of electrospun fibers causes the emitted fiber to move back and forth, the fiber 54 attaching circumferentially to the edges of the first segment 82 and the second segment 82.

Referring now to FIG. 15, a non-limiting image shows a preferred embodiment of the present invention where a plurality of nanofibers 54 is attached to the first segment 82 (i.e., a disk) and the second segment 83 (i.e., a disk) the attachments being at the circumferential edges, spanning across the length of the intermediate segment 81 (i.e., an elongated cylinder). The charged electrospun fiber 54 is attracted to the first segment 82 and the second segment 83 which are charged at an opposite polarity with respect to the charge applied to the emitter 12 and the charged fiber 54. The whipping action characteristic of electrospun fibers causes the emitted fiber to move back and forth, the fiber 54 attaching circumferentially to the first segment 82 and the second segment 83 at the edges. The first segment 82, the intermediate segment 81, and the second segment 83 are collectively rotated by at least one drive motor (59, 59) about a longitudinal axis. During collective rotation of the segments, nanofibers 54 attach at multiple points around the perimeter of the first segment 82 and the second segment 83, the nanofibers 54 being substantially aligned and spanning the separation space occupied by the intermediate segment 81. Electrically grounding the the intermediate segment 81 attracts the nanofibers 54 to the surface of the intermediate segment 81.

Referring now to FIG. 16, a non-limiting image shows a preferred embodiment of the present invention where a plurality of nanofibers 54 is attached between the first segment 82 (i.e., a disk) and the second segment 83 (i.e., a disk), substantially aligned and spanning across the length of the intermediate segment 81 (i.e., an elongated cylinder). A plurality of branched fibers 86 expelled from the emitter 12 is attracted between the charged emitter 12 and a steering electrode 87 having an opposing charge, the branched fibers 86 being substantially aligned and spanning orthogonally across and proximate to the nanofibers 54 attached to the first segment 82 and the second segment 83. The emitter 12 is configured for electrospinning nanoscale fiber streams comprising many charged fiber branches, can be electrically charged and has a tip positioned offset away from and between the edge of the first segment and the edge of the second segment. A support structure is provided for rotating the elongated assembly (first segment 82, second segment 83, and intermediate segment 81) about a longitudinal axis and no electrical charge is applied to the first segment 82 and second segment 83 while the steering electrode 87 is electrically charged. The electrically chargeable steering electrode 87 is provided for attracting the fiber streams along motion pathways substantially orthogonal to motion pathways of fiber streams attracted to the first segment 82 and second segment 83 spanning the intermediate segment 81. The fibers 86 are attracted to the surface of the intermediate segment 81 when it becomes electrically grounded, and overlay nanofibers 54 present at the surface of the intermediate segment 81 during collective rotation of the first segment 82, the second segment 83, and the intermediate segment 81. By alternating the application of an opposing charge on the electrode 87 with applying an opposing charge on the first and second segments (82 & 83) collectively, multiple layers of nanofibers (54 & 86) can be accumulated, the nanofibers in each layer being substantially aligned and substantially orthogonal to nanofibers comprising an adjacent layer.

Referring now to FIG. 17, a non-limiting image shows a preferred embodiment of the present invention configured with a first segment 82 (i.e., metallic ribbon), a second segment 83 (i.e., metallic ribbon), a third segment 84 (i.e., metallic ribbon), and a forth segment 85 (i.e., metallic ribbon), where a plurality of nanofibers 54 is attached between the third segment 84 (i.e., metallic ribbon) and the fourth segment 85 (i.e., metallic ribbon), spanning across the length of the intermediate segment 81 (i.e., an elongated cylinder) between the third and fourth segments (84 & 85). The metallic ribbons are attached to and electrically insulated from the intermediate segment 81. The charged electrospun nanofiber 54 is attracted to the third segment 84 and the fourth segment 85, the first segment 82 and the second segment 83 being maintained in an electrically neutral state. The third segment 84 and the fourth segment 85 are charged at an opposite polarity with respect to the charged electrospun nanofiber 54. The whipping action characteristic of electrospun fibers causes the emitted fiber to move back and forth the expelled fiber attaching to circumferentially to the third segment 84 and the fourth segment 85. The first segment 82, third segment 84, intermediate segment 81, second segment 83, and fourth segment 85 are collectively rotated by at least one drive motor (58, 59) about a longitudinal axis. Nanofibers 54 attach at multiple points around the perimeter of the third segment 84 and the fourth segment 85, spanning the separation space occupied by the intermediate segment 81 between the third and fourth segments (84 & 85), the nanofibers 54 being substantially aligned. Electrically grounding the the intermediate segment 81 attracts the nanofibers 54 to the surface of the intermediate segment 81 between the third and fourth segments (84 & 85). The length of nanofibers 54 collected may be altered by selecting collectively for applying a charge either the first and second segments (82 & 83) or the third and fourth segments (84 & 85). Charging the first and second segments (82 & 83) will cause longer fibers to be collected than collecting fibers between charged third and fourth segments (84 & 85).

Referring now to FIG. 18, a non-limiting image shows a preferred embodiment of the present invention where a plurality of nanofibers 54 is attached between the third segment 84 (i.e., metallic ribbon) and the forth segment 85 (i.e., metallic ribbon), spanning across the length of the intermediate segment 81 (i.e., an elongated cylinder) between the third and fourth segments (84 & 85). A plurality of branched nanofibers 86 is attracted between a charged emitter 12 and an electrode 87 having an opposing charge, the branched nanofibers 86 substantially aligned and spanning substantially orthogonally across the nanofibers 54 attached to the third and fourth segments (84 & 85). The emitter 12 is configured for electrospinning nanoscale fiber streams comprising many charged fiber branches 86, can be electrically charged and has a tip positioned offset away from and between the edge of the third segment 84 and the edge of the fourth segment 85. A support structure is provided for rotating the elongated assembly (first segment 82, second segment 83, third segment 84, fourth segment 85, and intermediate segment 81) about a longitudinal axis and no electrical charge is applied to the first segment 82, second segment 83, third segment 84, or fourth segment 85 while the steering electrode 87 is electrically charged. The electrically chargeable steering electrode 87 is provided for attracting the fiber streams along motion pathways substantially orthogonal to motion pathways of fiber streams attracted to the third and fourth segments (84 & 85) spanning the intermediate segment 81 between those segments. The fibers are attracted to the surface of the intermediate segment 81 between the third and fourth segments (84 & 85) as it is electrically grounded when the electrode 87 is electrically charged. The length of nanofibers 54 collected may be altered by selecting collectively for applying a charge either the first and second segments (82 & 83) or the third and fourth segments (84 & 85). Charging the first and second segments (82 & 83) will cause longer fibers to be collected than collecting fibers between charged third and fourth segments (84 & 85). Concurrently electrically grounding the intermediate segment 81 only in the span between charged third and fourth segments (84 & 85) will result in a cross-alignment of nanofibers having a narrower width than charging the first and second segments (82 & 83) while grounding the intermediate segment 81 and third and fourth segments (84 & 85) collectively.

Referring now to FIG. 19, a non-limiting image shows a preferred embodiment of the present invention where the first segment 82 (i.e., a disk) and the second segment 83 (i.e., a disk), each rotationally mounted on a separate drive motor (58, 59) and moveably separable on a base mount 50, are adjusted to accept the intermediate segment 81 between the first segment 82 and the second segment 83 (i.e., disks). The intermediate segment 81 (i.e., cylinder) connects to the first segment 82 and the second segment 83 (i.e., disks) using insulating connectors 91 and 93. The first segment 82 and the second segment 83 are electrically chargeable. The intermediate segment 81 can be maintained electrically neutral or at electrical ground. The first segment 82 and the second segment 83 are mounted on separately controllable drive motors (58 & 59) that are movably mounted on the base mount 50. The span between the first segment 82 and the second segment 83 may be increased to enable mounting the intermediate segment 81 on the insulating connectors 91 and 93. The insulating connectors 91 and 93 may be configured to insert into receiving ports 92 and 94 respectively. The span is reduced to secure the intermediate segment 51 in operating position. Intermediate segments of differing lengths may be selected and installed between the first segment 82 and the second segment 83 to produce fibrous membranes of corresponding width and comprising cross-aligned nanofibers collected at the surface of the intermediate segments 81 using the method and apparatus as taught herein. Attaching a fabric to the intermediate segment 81 prior to initiating electrospinning operation will collect nanofibers 54 and 86 on its surface and enable a method of harvesting cross-aligned fiber membranes after a desired layer count is achieved and electrospinning operation is completed.

Referring now to FIG. 20, a non-limiting image shows a method of the present invention for fabricating cross-aligned nanofiber membranes usable in constructing at least a layered wound care dressing. An emitter for solid or core-shell fiber production is selected. Nanoscale fiber streams are electrospun from at least one emitter (FIG. 13—12), the fiber streams (FIG. 13—53) comprising many charged fiber branches, the at least one emitter (FIG. 13—12) being electrically charged and having a tip positioned offset away from and between the first segment (FIG. 13—82) and the second segment (FIG. 13—83). The first segment (FIG. 13—82) and the second segment (FIG. 13—83) are charged by applying a voltage having a first polarity, while maintaining the intermediate segment (FIG. 13—81) at one of an electrical neutral or electrical ground, the charging imparting a polarity opposing a charge on the at least one emitter (FIG. 13—12) realizing an electrical potential difference. The elongated assembly, collectively the first segment, second segment, intermediate segment (FIG. 13—82, 83, 81) is rotated about a longitudinal axis, and the charged fiber branches are attracted by the opposing electrical charge on to a circumferential edge of the first segment (FIG. 13—82) and the second segment (FIG. 13—83), where the fibers alternately attach to the circumferential edge of the first segment (FIG. 13—82) and the second segment (FIG. 13—83), spanning a separation distance occupied by the intermediate segment (FIG. 13—81) between the first segment (FIG. 13—82) and the second segment (FIG. 13—83). The intermediate segment (FIG. 13—81) is maintained electrically neutral, and set to electrical ground only when the electrical charge is removed from the first segment (FIG. 13—82) and the second segment (FIG. 13—83). Cross-aligned fibers (FIG. 16—86) are collected over a nanofiber layer (FIG. 16—54) collected at the surface of the intermediate segment (FIG. 16—81) by rotating the elongated assembly and electrically charging at least one steering electrode 87 with a charge exhibiting an opposing polarity to the charge applied to the at least one emitter 12 producing a charged fiber stream. Branch fibers (FIG. 16—86) separate along field lines in the electromagnetic field produced by the opposing electrical charges applied to the at least one emitter (FIG. 16—12) and the at least one electrode (FIG. 16—87), and the charged nanofiber branches 86 attach circumferentially to at least the intermediate segment (FIG. 16—81), the intermediate segment (FIG. 16—81) being electrically grounded. The nanofibers (FIG. 16—86) are attracted to the surface of the intermediate segment (FIG. 16—81) and overlay nanofibers (FIG. 16—54) present at the surface of the intermediate segment (FIG. 16—81) during collective rotation of the first segment (FIG. 16—82), the second segment (FIG. 16—83), and the intermediate segment (FIG. 16—81). By alternating the application of an opposing charge on the electrode (FIG. 16—87) with applying an opposing charge on the first and second segments ((FIGS. 16—82 & 83) collectively, multiple layers of nanofibers (FIGS. 16—54 & 86) can be accumulated, the collected nanofibers in each layer being substantially aligned and substantially orthogonal to collected nanofibers comprising an adjacent layer.

The non-limiting diagrams of FIG. 13 through 19 show the adapted apparatus of FIG. 5A comprising an elongated assembly having a plurality of segments consisting of at least a first segment 82, a second segment 83, and an intermediate segment 81, where the first segment 81 is positioned at one end of the intermediate segment 81 and the second segment 82 is positioned at an opposite end of the intermediate segment 81. Each of the segments are electrically chargeable and the first segment and second segment present a circumferential edge to electrospun nanofibers. At least one emitter 12 is configured for electrospinning nanoscale fiber streams comprising many charged fiber branches, and the at least one emitter 12 can be electrically charged and has a tip positioned offset away from and between the edge of the first segment 82 and the edge of the second segment 83. The emitter may be configured to produce solid of core-shell fibers as shown in FIG. 11. A support structure on a base mount 50 is provided for rotating the elongated assembly comprising at least three segments (81, 82, 83) about a longitudinal axis and applying an electrical charge to at least the first segment 82 and second segment 83. At least one electrically chargeable steering electrode 87 is provided for attracting the fiber streams along motion pathways substantially orthogonal to motion pathways of fiber streams attracted to the first and second segments (82 & 83). A plurality of anodes may also be configured as shown in FIG. 21. The at least one steering electrode 87 receives a charge having an electrical polarity opposing a charge applied to the at least one emitter 12. The elongated assembly may be cylindrical and the first segment 82 and the second segment 83 are electrically insulated from the intermediate segment 81. The first segment 82 and the second segment 83 may each comprise at least a metallic disk. A plurality of steering electrodes (FIGS. 21—87) may be incorporated, the steering electrodes being programmably chargeable so that motion pathways of branched fiber streams toward the electrodes from the at least one emitter 12 is alterable. The position of the emitter 12 may also be altered to further adjust the angle at which fiber may be collected on the intermediate segment 81. In addition, a plurality of programmably chargeable segments. e.g., metallic ribbons) may be included adding to the number of segments positioned toward each end of the elongated assembly (e.g. cylinder), each additional segment being separated from an adjacent segment by a finite distance and electrically insulated from the intermediate segment 81. The plurality of programmably chargeable segments may comprise metallic ribbons circumferentially engaging and electrically insulated from the elongated assembly (e.g. cylinder). A controller 100 may be included for governing the charge status of chargeable components of the adapted apparatus. The controller 100 may be programmed for example to enable changing the charge status of metallic ribbons, as well as the charge status of steering electrodes, where the chargeable components receive an electrical charge from a high-voltage power supply 13. Selectively applying a charge to corresponding ribbon pairs, one ribbon of each pair being located toward each end of the elongated assembly, enables rapid apparatus configuration changes by altering the separation distance between charged ribbons. Altering the separation distance enables fabrication of cross-aligned fiber layers exhibiting greater or lesser width for fabrication of various size nanofiber membranes usable for example in drug delivery dressings of various sizes. The at least one steering electrode 87 may be fixedly mounted in-line with the at least one emitter 12. Alternatively, a plurality of electrodes may also be fixedly mounted opposite the at least one emitter 12 and oriented on a common plane in-line with the at least one emitter 12. Charging may be selectively applied to each electrode in the plurality of electrodes during electrospinning to alter the motion pathways of branched fibers to apply fibers in one layer on the elongated assembly at adjustable oblique angles relative to fibers applied in a previously applied layer. The at least one steering electrode 12 may also be movably mounted on a robotic arm for repositioning with respect to the emitter and the elongated assembly. Repositioning the at least one electrode 12 during electrospinning may be used to apply fibers in one layer on the elongated assembly at adjustable oblique angles relative to fibers applied in a previously applied layer. A plurality of electrodes may also be mounted on the robotic arm and charging may be selectively applied to each electrode in the plurality of electrodes.

The present invention as shown in non-limiting diagrams of FIGS. 13 through 19 and 21 may include at least one coaxial emitter 12 (i.e., spinneret) for producing core-shell nanofiber. In a preferred embodiment, the method for collecting fiber threads, comprises providing at least an electrospinning apparatus configured as shown in FIGS. 13, 16, and 21 the apparatus comprising the elongated assembly (81, 82, 83) having a plurality of segments consisting of at least a first segment 82, a second segment 83, and an intermediate segment 81, the first segment 82 positioned at one end of the intermediate segment 81 and the second segment 83 positioned at an opposite end of the intermediate segment 81. Nanoscale core-shell fiber streams are electrospun from at least one coaxial emitter 12, the fiber streams comprising many charged fiber branches, the at least one coaxial emitter 12 being electrically charged and having a tip positioned offset away from and between the first segment and the second segment. The first segment 82 and the second segment 83 are charged by applying a voltage having a first polarity, while maintaining the intermediate segment 81 at one of an electrical neutral or electrical ground, the charging of segments 82 and 83 imparting a polarity opposing a charge on the at least one coaxial emitter 12, realizing an electrical potential difference. The elongated assembly (81, 82, 83) comprising at least three segments (82, 83, 81) is rotated about a longitudinal axis, and the charged fiber branches 54 are attracted by the opposing electrical charge on a circumferential edge of the first segment 82 and the second segment 83, longitudinally spanning the intermediate segment 81. The back and forth whipping motion typical of fibers produced by electrospinning presents fiber branches toward the ends of the elongated assembly (81, 82, 83) where the fibers 54 alternately attach to the circumferential edge of the first segment 82 and the second segment 83, spanning a separation distance between the first segment 82 and the second segment 83. The intermediate segment 81 is maintained electrically neutral during fiber 54 collection on the circumferential edges of the first segment 82 and the second segment 83, and set to electrical ground when the electrical charge is removed from the first segment 82 and the second segment 83. Grounding the intermediate segment 81 attracts the charged core-shell fibers that span the separation distance between the first segment 82 and the second segment 83 to the surface of the intermediate segment 81. Attraction of fibers 54 to the intermediate segment 81 may also be accomplished by applying a charge to the intermediate segment 81, the charge having a polarity opposing the charge present on the fibers 54. Cross-aligned core-shell fibers are collected on a previously collected fiber layer on the intermediate segment 81 spanning the separation distance between the first segment 82 and the second segment 83 by rotating the elongated assembly (81, 82, 83) and electrically charging at least one steering electrode 87 with a charge exhibiting an opposing polarity to the charge applied to the at least one coaxial emitter 12 producing a charged core-shell fiber stream. Branch fibers 86 separate along field lines in the electromagnetic field produced by the opposing electrical charges applied to the at least one coaxial emitter 12 and the at least one electrode 87. Charged fiber branches 86 are attracted along motion pathways from the at least one coaxial emitter 12 toward the at least one steering electrode 87. The elongated assembly (81, 82, 83) is positioned (line-of-sight) to intercept the fiber branches 86, and the charged fiber branches 86 attach circumferentially to at least the intermediate segment 81, the intermediate segment 81 being electrically grounded or having a charge opposing the charge present on the fibers 86. The emitter assembly 10 may be adjustably 230 positioned to alter the angle at which branch fibers 86 expelled from the at least one emitter 86 cross the rotating elongated assembly (81, 82, 83).

A collector pallet (not shown) in the form of a fabric or other porous material may be attached circumferentially around at least the intermediate segment 81 of the elongated assembly (81, 82, 83) positioned between the first and second segments (82 & 83). The charged fiber branches 86 in the core-shell fiber streams attach to the surface of the collector pallet (not shown) between the charged first and second segments (82 & 83) across the separation distance when the charge is removed from the first and second segments (82 & 83) and the intermediary segment 81 is electrically grounded or electrically charge with an opposing charge. The charged core-shell fiber streams attach to the collector pallet (not shown) between the electrically neutral first and second segments (82 & 83) around the circumference of the electrically grounded or charged intermediary segment 81 when the charged core-shell fiber streams 86 assume a motion pathway toward the at least one electrically charged electrode 87 and are intercepted by the rotating elongated assembly (81, 82, 83). Repeating the forgoing process results in a fiber matrix comprising core-shell fiber layers where the fibers 86 in each layer of fibers 86 are substantially orthogonal to the fibers 54 in each adjacent layer of fibers 54.

In some embodiments, the at least one steering electrode 87 (e.g. as shown in FIGS. 16 and 18) may be movably mounted on a robotic arm assembly (e.g. FIG. 6) for repositioning with respect to the emitter 12 and the elongated assembly (81, 82, 83). Repositioning the at least one electrode 87 alters the motion pathway of fibers 86 during electrospinning and may be used to apply fibers 86 in one layer on the elongated assembly (81, 82, 83) at oblique angles to fibers 54 applied in a previously applied layer. In some embodiments, a plurality of electrodes 87 (e.g. FIG. 21) may also be mounted on a robotic arm assembly (e.g. FIG. 6) or they may be fixedly mounted on a base 211. By controlling the level of charge applied to each steering electrode 87 in a plurality of steering electrodes and the sequencing in which the charging is applied, the motion pathways of the charged fiber branches 86 toward the plurality of steering electrodes 87 mounted on the base 211 can be altered and fiber application on to at least the intermediate segment 81 of the elongated assembly (81, 82,83) can be controlled. In some embodiments, the first and second segments (82 & 83) may also be electrically grounded along with the intermediate segment 81 depending upon the operating requirements for the material being electrospun. The collector pallet 89 affixed circumferentially around at least the intermediate segment 81 of the elongated assembly (81, 82, 83) may comprise one of a biomedical textile or a wound dressing medical fabric, and single or a plurality of textile or fabric layers may be used to construct a pallet. A layered drug delivery dressing can be fabricated using the present method and apparatus, combining nanofibers formulated for drug release with biomedical textile or other type of wound dressing fabric, and further assembled using components typical of medical dressings, such a matrix s a coagulant, absorbents. Multiple fiber types, including but not limited to solid and core-shell, may be electrospun by configuring the emitter assembly 210 with multiple emitters 212 as shown in FIG. 22. The chemical composition of the fibers electrospun from each emitter in the emitter assembly 210 may differ. The resultant fiber matrix may include tissue growth stimulants, the fiber matrix providing for example a three-dimensional (3D) scaffold or an extracellular matrix (ECM) to support tissue regeneration.

EXAMPLES

The present disclosure can be better understood with reference to the following non-limiting examples.

Aligned Fiber on Biomedical Implants

The apparatus of the single disk configuration of the present invention for the control of the branching of fiber in an electrospin process is illustrated in FIG. 2 and FIG. 3. The invention as illustrated in FIG. 2 and FIG. 3 was used to configure an electrospinning unit to deposit aligned uni-direction polymer fibers on both a round hip implant and a flat sample material. Polycaprolactone (PCL), available from Sigma Aldrich, was selected as fiber material since it produces branches during Electrospinning process. PCL solution was prepared by ultrasonic (Sonics & Materials, Inc., Vibra-cell VCX 130) mixing of 7.69 wt % of PCL beads with acetone. The sonication process was carried out at approximately 80° C. for an hour. The solution was poured into a glass syringe in an infusion pump (Harvard Ins.).

A polymer solution was poured into a glass syringe in an infusion pump FIG. 3-10 for fiber production. Polymer was ejected from the glass syringe via a charged needle through a flexible tube. The needle FIG. 3-12 was charged by high voltage power source FIG. 3-13. The needle was attached with a wooden bar FIG. 3-9. The bar is attached with the sealable chamber FIG. 3-20 using a flexible adjusting clamp. The height of the needle can be adjusted by the wooden bar. A metallic saw blade FIG. 3-15 (referred to herein as auxiliary metallic disk) was positioned between two insulating washers FIG. 2-22 and FIG. 2-23. ABS plastic was the material used to produce the two insulating disks created using a 3D printer (Stratasys Inc., model—Dimension Elite). The metallic disc components were then spun on an aluminum shaft FIG. 3-24 via DC motor and held fastened by the grounding bolt.

A DC motor FIG. 3-16 was mounted on a precision linear stage (Newport Corporation, model#426). The motion of the stage was controlled by a linear actuator (Newport Corporation, model #LTA-HS) FIG. 3-19 to produce aligned uni-direction fiber on titanium rod fastened to the motor shaft. The fibers produced were deposited on a collector (not attached with the motor) which is fastened with the shaft. The auxiliary disk and implant was grounded and used in the electrospinning process for producing the aligned fibers shown in the micrograph presented in FIG. 7. As shown in the stereo FIG. 7(*a*) and scanning electron microscope FIG. 7(*b*) images, the present invention enables relatively precise collection of aligned fibers on a target sample. In a non-limiting example, a round rod is precisely moved to intercept the fiber path when it is spun. This interception and rotation causes a stripping of the fibers and results in alignment on the target sample. This interception point can be in several different locations with variable distances FIG. 7(*c*) with the method of interception varying with the equipment employed.

The electrospin process of the present invention was used for the deposition of aligned fiber on different shapes of titanium implants. The shapes of implants were round, hip, and flat shape implants. This process provides the capability of high precision for controlling deposition of the fibers and producing nano-level fibers. Each of the different kinds of implants was secured to their holders by different ways. A plurality of variable-shape holders was made using a 3D printer (Dimension elite 3D printer) in order to deposit aligned fiber on round hip implant and flat shape implants. Titanium (Ti) round and flat shape implants (6Al-4V ELI, ASTM B 348 standard, grade 23, biocompatible) available from Titanium Metal Supply, Inc., Poway, Calif. were used as implant materials. BioMet Inc. hip implant was used as hip shape implant. Round implant was secured on a cylinder shape holder using locknut. Hip implants were placed in the channel between the two pieces of hip implant holders and secured by a bolt and nut. Flat implants were glued on a hollow cylinder. The cylinder was press fitted on the flat shape implant holder. The selected implant holders ware press fitted on the shaft of the motor to deposit fiber on those implants. The implant was spun at high speed with a DC motor which was used in conjunction with a Probably Integral Derivative (PID) control system to control the revolutions of the motor under the electrospinning setup.

Cell Viability Tests to Find Fibers Effects on Biocomtability of Ti

The effect of PCL and collagen (CG)-PCL coatings on Ti to the biocompatibility properties of Ti were examined. Three groups of Ti samples were prepared: (1) PCL coated Ti, (2) CG coated Ti (Ti/CG), and (3) CG and PCL coated Ti (Ti/CG/PCL). Ti surfaces were coated with thin layer of CG. Electrospun PCL fibers were randomly deposited on CG coated Ti to prepare Ti/CG/PCL samples. A custom made silicon well (FIG. 8*a*) was used to culture cells on each group of Ti surfaces. Mouse osteoblast cells (ATCC cell line #MT3T3E1) were seeded at a density of 5000 cells/ml on each well of Ti samples. Cells were cultured for 2 weeks on Ti samples in the well according to ATCC protocols. The cells were then fixed with neutral buffer formalin and stained with DAPI to identify nuclei. The resulting stain was viewed with a fluorescent microscope. The quantitatively and qualitatively measurement of cell viability on the Ti surfaces were conducted from the captured images. The study found negligible cell attachment and proliferation on only PCL coated Ti. Cells proliferate successfully on the surface of Ti/CG and Ti/CG/PCL samples. Cells grew along the fiber direction on Ti/CG/PCL surfaces with increased cell clustered along the fibers. Cell densities of Ti/CG/PCL samples were significantly higher compare to Ti/CG samples (FIG. 8*b*). These results suggested that PCL fiber positively influence the osseointegration of Ti surface that may lead to enhance in vitro and in vivo mechanical integration of Ti/bone interfaces.

In Vitro Tests to Evaluate PCL Fiber Effect on Ti/Bone Interfaces

The influence of the osseointegration on the bonding strength, $\sigma_t$, between Ti and bone scaffold due to CG and CG/PCL fiber coatings on Ti were examined. Beta tricalcium phosphate (β-TCP) (3D Biotek, LLC, NJ) disk (9.5 mm diameter×1.6 mm thickness) was used as bone scaffold. Cells were cultured on the top of Ti, Ti/CG, Ti/CG/PCL and β-TCP surfaces for 14 days. β-TCP were placed on top of Ti/CG and Ti/CG/PCL specimen in a custom made acrylic well to make the coupled β-TCP-Ti/CG and β-TCP-Ti/CG/PCL specimen. A set of weights was placed on the samples via acrylic rod to avoid any displacement of the samples during cell culturing for 2 months. The coupled samples were glued on the holders in the Evex tensile test stage. Tension tests were conducted at strain rate 0.001 mm/sec to determine the $\sigma_t$ values of the samples. We have found that no bonding between Ti and β-TCP whereas Ti/β-TCP samples with CG and CG-PCL showed noticeable bonding strength, $\sigma_t$, though the differences of $\sigma_t$ between those samples were not significant. This result suggested that both CG and CG-PCL can improve the bonding of Ti/bone. Further in vitro and in vivo improvement of Ti/bone union is possible by aligned, uniform and less stiff fiber on Ti using PCL nanofibers and MgO nanoparticles that is sought in future study.

Aligned Fiber Applications Using the Present Invention

The single disk configuration disclosed for the present invention may be used for precision deposition of fiber on parallel surfaces as shown in FIG. 10. This was done by negatively charging the parallel plates and attaching them on a linear stage. The electro spun fibers reacted to the electric field and aligned along the field lines between both plates. This arrangement was used to test the tensile strength of the fibers produced which shows super plastic behavior of the aligned fiber strip.

Aligned Fiber Applications Using the Dual Disk Method of the Present Invention

The dual disk configuration of the present invention evolved from using the single disk setup into a new concept advanced from the knowledge gained from trial and error. The invention progressed from basic parallel plates, to a variation/blend of parallel plates and sharp blade, then ending with a completely new technique for achieving electrospun alignment. This new technique is a combination of parallel/drum/and sharp blade setups or PRD (Parallel Rotating Disks).

The specific setup for the dual disk configuration is dependent on the chemical solution being used to produce fibers. Factors such as viscosity, chemical makeup, and viscoelastic conditions dictate the tilt, speed, and voltage required to effectively electrospin the fibers. A solution customization process is used to optimize the collection of aligned fibers. This process is:

1. Determine the desired length of fiber.
2. Set blade stands to accommodate length from number 1.
3. Understand the viscoelastic relationship as it relates to surface tension.
4. Adjust the height of the needle to allow a sufficient room for the Taylor cone and fiber plumb to form.
5. The voltage should start low and slowly be increased until the Plumb is wide enough to accomplish the desired length of the fiber on the blade.
6. Once the fibers start to collect on the blade adjust the tilt to eliminate the arcing due to residual electric charge.
7. Depending on application the rotation of the blades can be slowly increased to the desired speed.

Once the fibers have been optimized a collection surface may be positioned in the pathway of the fibers (See FIG. 5*d*). This can be done several different ways. The method with the most options was found to be an arm with variable control (angular, linear, along with extended rotational ability). The arm presented in FIG. 7 allows for single, parallel, and bidirectional (also known as scaffolding) fiber collection, and includes rotational components for changing position of a substrate. Other methods considered and tested include a fixed arm, arch stand, and belt stands.

Example Applications for Use of the Present Invention

Nanofiber scaffolding structures and aligned fibers produced using the apparatus and methods of the present invention have applications in medicine, including artificial organ components, tissue engineering, implant material, drug delivery, wound dressing, and medical textile materials. Nanofiber scaffolding structures may be used to fight against the HIV-1 virus, and be able to be used as a contraceptive. In wound healing, nanofiber scaffolding structures assemble at the injury site and stay put, drawing the body's own growth factors to the injury site. These growth factors comprise naturally occurring substances such as proteins and steroid hormones capable of stimulating cellular growth, proliferation, healing, and cellular differentiation. Growth factors are important for regulating a variety of cellular processes. Scaffolding structures produced by the present invention and methods may be used to deliver medication to a wound site.

Protective materials incorporating nanofibers produced by the present invention and methods may include sound absorption materials, protective clothing directed against chemical and biological warfare agents, and sensor applications for detecting chemical agents. Gloves incorporating aligned fibers and scaffolding structures produced by the apparatus and methods of the present invention may be configured to provide persistent anti-bacterial properties. Applications in the textile industry include sport apparel, sport shoes, climbing, rainwear, outerwear garments, and baby-diapers. Napkins with nanofibers may contain antibodies against numerous biohazards and chemicals that signal by changing color (potentially useful in identifying bacteria in kitchens).

Filtration system applications include HVAC system filters, ULPA filters, air, oil, fuel filters for automotive, trucking, and aircraft uses, as well as filters for beverage, pharmacy, medical applications. Applications include filter media for new air and liquid filtration applications, such as vacuum cleaners. Scaffolding structures produced by the apparatus and methods of the present invention enable high-efficiency particulate arrestance or HEPA type of air filters, and may be used in re-breathing devices enabling recycling of air. Filters meeting the HEPA standard have many applications, including use in medical facilities, automobiles, aircraft and homes. The filter must satisfy certain standards of efficiency such as those set by the United States Department of Energy (DOE).

Energy applications for aligned fibers and scaffold structures produced using the apparatus and methods of the present invention include Li-ion batteries, photovoltaic cells, membrane fuel cells, and dye-sensitized solar cells. Other applications include micropower to operate personal electronic devices via piezoelectric nanofibers woven into clothing, carrier materials for various catalysts, and photocatalytic air/water purification.

Using the method and apparatus of the present invention, aligned fibers may be arranged in a similar orientation as ligament. The aligned fibers can be collected in several rows and then spun into a thread, which would be usable as a ligament. The invention implemented for this application may be configured as a portable device, where a clinician in a hospital setting could use the aligned fiber to make skin like sutures.

Using the method and apparatus of the present invention, aligned fibers may be applied to a substrate comprising a strip of paper, fabric, or tissue. Further heat treatment can be applied to melt the fibers to produce a very strong bond with the substrate. The bonded material could then be used as a healing "bandaid" to protect a wound and promote cell growth. Engineered tissue cells or nanomedicine will be attached to the pad and the "bandaid" applied to allow it to protect while it reacts with the white blood cells to bond and deliver medication.

Aligned fibers produced using the method and apparatus of the present invention may be applied as a coating over electrostatic polymer to improve the electrical properties of polymer. The coated polymer could then be used to make artificial nerves for cochlear implants that could carry the electrical signals. The aligned fibers may also be used to enclose soft hydrogel to make intervertebral disk implant.

Using the method and apparatus of the present invention, aligned fibers may be arranged in a scaffold like structure and then coated or covered with a flexible bonding material where the combined product is layered on to a damaged surface as a repair or other purpose such as enabling a heating layer when a electric current is applied to the fiber.

Using the method and apparatus of the present invention, aligned fibers may be arranged in a scaffold structure where the spacing between fibers is adjusted to achieve a substantially specific numerical value to create a filter material having a defined porosity.

The apparatus of the present invention may be configured as a portable device movable between user locations to produce and align fiber on a substrate for a specific purpose. The apparatus of the present invention may also be configured as a stand-alone device integrated into a laboratory environment to produce and align fiber on a substrate for a plurality of research purposes. The apparatus of the present invention may be configured as a stand-alone manufacturing device for producing products incorporating aligned fiber.

The apparatus of the present invention may be configured with a single disk or multiple disks, and may be reconfigured from one arrangement to the other as required by a specific application. The apparatus of the present invention may be implemented in a plurality of physical enclosure configurations to produce and align fiber on a substrate for a specific purpose or a variety of applications. Auxiliary functions may be incorporated into the physical enclosure and include at least any of ventilation, heating, cooling, illumination, electric power interface and computer aided controls and associated programming. The enclosure may be sealable.

The apparatus of the present invention may be configured as part of a manufacturing process scaled to produce a relatively high volume of products incorporating aligned fiber. The scaled up manufacturing process may comprise multiple instances of the apparatus of the present invention. The apparatus may be configured in a plurality of sizes ranging from smaller scale machines suitable for low volume production to larger size machines suitable for larger volume production of products incorporating nanofibers. The machines sized in any scale may incorporate single disk or multiple disks configurations, and may be reconfigurable.

The apparatus and methods of the present invention may be used to coat a biomedical textile or a wound dressing medical fabric with cross-aligned nanofibers. Single or a plurality of textile or fabric layers may be used to construct a wound dressing. A layered drug delivery dressing can be fabricated using the present method and apparatus, combining nanofibers formulated for drug release with biomedical textile or other type of wound dressing fabric, and further assembled using components typical of medical dressings, such a matrix, a coagulant, and absorbents.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

The invention claimed is:

1. An apparatus for collecting cross-aligned fiber threads, comprising:

an elongated assembly having a plurality of segments consisting of at least a first segment, a second segment, and an intermediate segment, said first segment positioned at one end of said intermediate segment and said second segment positioned at an opposite end of said intermediate segment, each of said segments being electrically chargeable and said first segment and second segment presenting a circumferential edge;

at least one emitter for electrospinning nanoscale fiber streams comprising many charged fiber branches, said at least one emitter being electrically chargeable and having a tip positioned offset, away from, and between said edge of said first segment and said edge of said second segment;

a support structure for rotating said elongated assembly about a longitudinal axis and applying an electrical charge to at least said first segment and said second segment; and at least one electrically chargeable steering electrode for attracting said fiber streams said at least one steering electrode chargeable with an electrical polarity opposing a charge applied to said at least one emitter, wherein said elongated assembly is cylindrical and said first segment and said second segment are electrically insulated from said intermediate segment.

2. The apparatus of claim 1, wherein said first segment and said second segment each comprise at least a thin metallic disk.

3. The apparatus of claim 2, wherein said support structure is adapted to position said elongated assembly between said at least one emitter and said at least one steering electrode and to alter separation between said first segment and said second segment to accommodate mounting alternate length intermediate segments.

4. The apparatus of claim 1, comprising a plurality of steering electrodes, said electrodes being programmably chargeable so that motion pathways of said fiber streams toward said electrodes from said at least one emitter are alterable.

5. The apparatus of claim 1, wherein said elongated assembly is positioned to intercept said fiber streams in motion pathways traversed by said fiber streams toward said at least one steering electrode, said at least one steering electrode being one of fixedly mounted in-line with said emitter or movably mounted on a robotic arm for repositioning.

6. The apparatus of claim 1, comprising a plurality of programmably chargeable segments positioned toward each end of said elongated assembly, each segment separated from an adjacent segment by a finite distance.

7. The apparatus of claim 6, wherein said plurality of programmably chargeable segments comprise metallic ribbons circumferentially engaging and electrically insulated from said elongated assembly, and present a sharp edge.

8. The apparatus of claim 1, further comprising a controller for governing the charge status of chargeable components of said apparatus, said intermediate segment being adapted to accept at least a neutral, or grounded charge status.

9. The apparatus of claim 1, wherein said at least one emitter produces core-shell fibers.

10. An apparatus for collecting cross-aligned fiber threads, comprising:

an elongated assembly having a plurality of segments consisting of at least a first segment, a second segment, and an intermediate segment, said first segment positioned at one end of said intermediate segment and said second segment positioned at an opposite end of said intermediate segment, each of said segments being electrically chargeable and said first segment and second segment presenting a circumferential sharp edge electrically insulated from said intermediate segment;

at least one emitter for electrospinning nanoscale fiber streams comprising many charged fiber branches, said at least one emitter being electrically chargeable and having a tip positioned offset, away from, and between said sharp edge of said first segment and said sharp edge of said second segment;

a support structure for rotating said elongated assembly about a longitudinal axis and applying an electrical charge to at least said first segment and said second segment; and at least one electrically chargeable steering electrode for attracting said fiber streams along elliptical motion pathways, said at least one steering electrode chargeable with an electrical polarity opposing a charge applied to said at least one emitter.

11. The apparatus of claim 10, further comprising a controller for governing the charge status of at least said intermediate segment, wherein said intermediate segment is adapted to accept at least a neutral or grounded charge status.

12. The apparatus of claim 10, wherein said elongated assembly is positioned to intercept said fiber streams in said motion pathways traversed by said fiber streams toward said at least one steering electrode, said at least one steering electrode being one of fixedly mounted in-line with said emitter or movably mounted for repositioning.

13. The apparatus of claim 10, further comprising a controller for governing the charge status of chargeable components of said apparatus, wherein said intermediate segment is adapted to accept at least a neutral or grounded charge status.

14. An apparatus for collecting cross-aligned fiber threads, comprising:

an elongated assembly having a plurality of segments consisting of at least a first segment, a second segment, and an intermediate segment, said first segment positioned at one end of said intermediate segment and said second segment positioned at an opposite end of said intermediate segment, each of said segments being electrically chargeable and said first segment and second segment presenting a circumferential sharp edge electrically insulated from said intermediate segment;

at least one emitter for electrospinning nanoscale fiber streams comprising many charged fiber branches, said at least one emitter being electrically chargeable and having a tip positioned offset, away from, and between said sharp edge of said first segment and said sharp edge of said second segment;

a support structure for rotating said elongated assembly about a longitudinal axis and applying an electrical charge to at least said first segment and said second segment;

a controller for governing the charge status of at least said intermediate segment, said intermediate segment adapted to accept a positive, negative, neutral, or grounded charge status;

at least one electrically chargeable steering electrode for attracting said fiber streams along elliptical motion pathways, said at least one steering electrode chargeable with an electrical polarity opposing a charge applied to said at least one emitter, wherein said elongated assembly is positioned to intercept said fiber streams in said motion pathways traversed by said fiber streams toward said at least one steering electrode, said at least one steering electrode being one of fixedly mounted in-line with said emitter or movably mounted for repositioning.

* * * * *